US006823156B2

(12) United States Patent
Okamoto

(10) Patent No.: US 6,823,156 B2
(45) Date of Patent: Nov. 23, 2004

(54) DEVELOPING DEVICE, ROTARY DEVELOPING UNITS, IMAGE FORMATION APPARATUS AND A COMPUTER SYSTEM WITH A THICKNESS REGULATOR MEMBER AND A ROLLER SUPPORT FRAME

(75) Inventor: Katsumi Okamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/388,593

(22) Filed: Mar. 17, 2003

(65) Prior Publication Data

US 2003/0231907 A1 Dec. 18, 2003

(30) Foreign Application Priority Data

Mar. 15, 2002 (JP) ..... P2002-073185
Mar. 18, 2002 (JP) ..... P2002-073977
Mar. 18, 2002 (JP) ..... P2002-073991

(51) Int. Cl.[7] ..... G03G 15/08
(52) U.S. Cl. ..... 399/119
(58) Field of Search ..... 399/284, 119, 399/120, 274

(56) References Cited

U.S. PATENT DOCUMENTS 6,484,006 B2 * 11/2002 Izumi et al. ..... 399/284
6,512,910 B2 * 1/2003 Aoki et al. ..... 399/276
6,516,174 B1 * 2/2003 Izumi et al. ..... 399/284
6,519,437 B1 * 2/2003 Aoki et al. ..... 399/281

FOREIGN PATENT DOCUMENTS

JP 5-341637 A * 12/1993
JP 7-36279 A * 2/1995

* cited by examiner

*Primary Examiner*—Quana Grainger
(74) *Attorney, Agent, or Firm*—Sughrue Mion, PLLC

(57) ABSTRACT

A developing device includes a toner supporter for supporting toner, a toner supply member being pressed against the toner supporter to supply the toner to the toner supporter and a thickness regulation member for regulating thickness of the toner supplied to the toner supporter by the toner supply member. The thickness regulation member abuts the toner supporter on the toner supply member side of the toner supporter.

15 Claims, 18 Drawing Sheets

DEVELOPING DEVICE, ROTARY DEVELOPING UNITS, IMAGE FORMATION APPARATUS AND A COMPUTER SYSTEM WITH A THICKNESS REGULATOR MEMBER AND A ROLLER SUPPORT FRAME

BACKGROUND OF THE INVENTION

This invention relates to a developing device using toner as a developer, an image formation apparatus having the developing device, and a computer system including the image formation apparatus.

Also, this invention relates to a developing device used with an electrophotographic image formation apparatus such as a laser printer, a copier, or a facsimile for storing toner and developing a latent image formed on a photoconductor drum in the toner, in particularly, to a structure to fix a roller support frame of the developing device to a housing and to a structure to put a roller support frame, a developing roller, and a regulation blade of the developing device into a unit.

As the image formation apparatus, for example, an image formation apparatus having a developing device for developing a latent image formed on a photoconductor with toner as a developer or the like is known. The image formation apparatus has the developing device placed at a developing position opposed to the photoconductor for developing a latent image formed on the photoconductor to form a toner image in response to an image signal transmitted from an external apparatus such as a host computer.

FIG. 8 shows an example of the developing device. It is a schematic drawing to describe main components of the developing device. The developing device 200 shown in FIG. 8 has a casing 204 for forming a toner storage section 202 storing toner T, a developing roller 206 as a toner supporter supported in the casing 204 for rotation, a toner supply roller 208 as a toner supply member pressed against the developing roller 206 for supplying toner T to the developing roller 206, and a regulation blade 210 as a thickness regulation member for regulating the thickness of the toner T supplied to the developing roller 206.

The developing roller 206 is formed of metal and has a gap with a photoconductor 212. The developing device 200 forms an alternating electric field between the developing roller 206 and the photoconductor 212 and develops a latent image formed on the photoconductor 212 in a noncontact state.

The toner supply roller 208 has an elastic layer of polyurethane foam, etc., placed on the outer peripheral portion of a metal shaft, and is pressed against the developing roller 206 as it is elastically deformed.

The regulation blade 210 has a rubber part 210*a* and a rubber support part 210*b*. The rubber support part 210*b* is attached to the casing 204 via a blade support metal sheet 214. The rubber support part 210*b* is a thin plate of phosphor bronze, stainless steel, etc., having a spring property and serves as urging member for pressing the rubber part 210*a* into contact with the developing roller 206.

In the developing device 200, the toner T stored in the toner storage section 202 is supplied by the toner supply roller 208 to the developing roller 206. The supplied toner T has thickness regulated by the regulation blade 210 pressed against the developing roller 206 and is charged by friction and is transported to a developing position opposed to the photoconductor 212. The toner is moved by an alternating electric field formed between the developing roller 206 and the photoconductor 212, whereby a latent image on the photoconductor 212 is developed.

In the developing device 200, to provide a good image, the regulation blade 210 needs to be properly pressed against the developing roller 206 for making uniform the thickness of a toner layer formed on the developing roller 206, and the toner T needs to be charged evenly.

However, to reliably supply the toner T on the developing roller 206, the toner supply roller 208 made of urethane is pressed against the developing roller 206 made of metal. Both end parts of each of the rollers 206 and 208 are regulated by the casing 204 supporting the rollers 206 and 208 and the rollers 206 and 208 are pressed in a direction in which the rollers 206 and 208 approach each other. At this time, in the developing roller 206 and the toner supply roller 208, a force acting in a direction in which the centers are brought away from each other occurs because both ends are regulated. The toner supply roller 208 absorbs the force as urethane is elastically deformed, but the developing roller 206 is a rigid body and thus deflection in a direction in which the center is brought away from the toner supply roller 208 occurs.

When deflection occurs in the developing roller 206, the abutment position of the regulation blade 210 against the developing roller 206 shifts and the regulation blade 210 is not properly against the developing roller 206, making the thickness of the toner layer uneven and also making uneven the charge state by friction of the regulation blade 210, and good developing cannot be conducted.

Also, in a laser printer as an example of the image formation apparatus including a rotary developing unit, a plurality of developing devices storing toners of different colors are set in the rotary developing unit. At the printing time, while the rotary developing unit is rotated, the developing device of the necessary color is brought adjacent to a photoconductor drum. The toner is supplied on a latent image formed on the photoconductor drum and is transferred from the photoconductor drum through a transfer belt to a sheet of print paper, etc., for fixing.

Generally, the developing device has a housing made of a synthetic resin for storing toner and a roller support frame made of metal being fixed to the housing with screws for supporting a developing roller for rotation.

The roller support frame supports the developing roller, and a regulation blade is pressed against the peripheral surface of the developing roller uniformly in the length direction of the regulation blade so as to even toner on the peripheral surface of the developing roller.

However, in the related developing device, the synthetic resin of which the housing is formed has a larger thermal expansion coefficient than the metal of which the roller support frame is formed. When heat generated during the operation of the rotary developing unit conducts to the developing device, the housing is expanded larger than the roller support frame. The roller support frame may become deformed because of the expansion difference between the housing and the roller support frame.

Further, when the roller support frame becomes deformed as mentioned above, the distribution of the press pressure of the regulation blade against the peripheral surface of the developing roller changes in the length direction of the regulation blade. Thus the action of evening the toner by the regulation blade becomes insufficient and a high toner-density portion and a low toner-density portion are produced, causing low-quality print matter to be formed partially with a large density difference.

In the related developing device, the roller support frame is constituted by a frame member extending in parallel with the developing roller and side frame members bent in the same direction at 90 degrees from both ends of the frame member, and is shaped like a character U in cross section. Thus, a force is exerted to the developing roller when the developing roller is placed or removed, the roller support frame may become deformed. Accordingly, although a regulation blade was in contact with the peripheral surface of the developing roller in the length direction thereof at uniform pressure at the beginning, a local point on which pressure is exerted may occur or pressure may be exerted in a varied manner from side to side.

Thus, if the regulation blade cannot be maintained in a state in which it is in contact with the peripheral surface of the developing roller in the length direction thereof at uniform pressure, the evening effect of the regulation blade on the peripheral surface of the developing roller is not demonstrated and therefore the distribution of toner on the developing roller is made uneven, adversely affecting the quality of printed matter.

SUMMARY OF THE INVENTION

It is therefore an object of the invention to provide a developing device for making it possible to suppress unevenness of the thickness of a toner layer formed on a developing roller and charge unevenness of toner for conducting good developing, an image formation apparatus having the developing device, and a computer system having the image formation apparatus.

Also, it is other object of the invention to provide a roller support frame fixing apparatus of a developing device and a developing device including the roller support frame fixing apparatus wherein a roller support frame does not become deformed if a housing and the roller support frame are expanded or contracted by heating or cooling assuming that there is a thermal expansion coefficient difference between a material of which the housing is formed and a material of which the roller support frame is formed.

Further, It is still other object of the invention to provide a developing device having a structure for enabling a regulation blade to maintain a state in which the regulation blade is in contact with the peripheral surface of a developing roller in the length direction thereof at uniform pressure, and a rotary developing unit including the developing device.

In order to achieve the above object, according to the present invention, there is provided a developing device comprising:

a toner supporter, which supports toner;

a toner supply member, which is pressed against the toner supporter to supply the toner to the toner supporter; and a thickness regulation member, which regulates thickness of the toner supplied to the toner supporter by the toner supply member, wherein the thickness regulation member abuts the toner supporter on the toner supply member side of the toner supporter.

In the above configuration, the thickness regulation member is abutted against the toner supporter from the toner supply member side thereof and thus even if the toner supporter is pressed by the toner supply member and deflection occurs in the toner supporter, it is made possible to abut the thickness regulation member against the toner supporter along the deflection of the toner supporter. Therefore, the thickness regulation member can be properly abutted against the toner supporter and it is made possible to suppress unevenness of the thickness of a toner layer and charge unevenness of toner.

Preferably, the thickness regulation member is provided with a non-abutment part at a tip being far from the abutment position against the toner supporter.

In the above configuration, the tip of the thickness regulation member and the toner supporter form a gap leading to the abutment part. Thus, surplus toner occurring as the toner layer is regulated by the thickness regulation member is accumulated in the gap; when shortage of toner occurs, the accumulated toner is supplied, whereby it is made possible to form a toner layer of uniform thickness.

Preferably, the toner supply member is placed at ahead of the tip of the thickness regulation member in a direction in which the thickness regulation member extends.

In the above configuration, it is made possible to supply toner from the gap at the tip of the toner supply member.

Preferably, the toner supporter is a roller comprised of metal, and the toner supply member is a roller covered an outer peripheral portion thereof with an elastic material.

In the above configuration, the toner supply member can be elastically deformed and pressed against the toner supporter of a rigid body, so that it is made possible to cause the toner supporter to reliably support toner.

Preferably, the developing device further comprising a support member, which supports the toner supporter and the toner supply member at both end sides so that the toner supporter and the toner supply member are urged in a direction of approaching each other.

In the above configuration, it is made possible to reliably abut the toner supply member against the toner supporter without affecting the toner layer formation part of the toner supporter or the toner supply part of the toner supply member.

Here, it is preferable that, the toner supporter and the toner supply member have outer peripheral parts in contact with each other, and ends of the outer peripheral part of the toner supply member are placed inside ends of the outer peripheral part of the toner supporter.

In the above configuration, supply of toner to the end parts of the toner supporter can be suppressed, so that it is made possible to prevent surplus toner from leaking to the end part sides.

Here, it is preferable that, the toner supporter supports the toner supplied from the toner supply member and rotates, and the thickness regulation member abuts the toner supporter in the range of 90 degrees in a rotation direction of the toner supporter from a center of a contact part between the toner supporter and the toner supply member.

In the above configuration, the width of the non-abutment part at the tip of the thickness regulation member becomes almost uniform in the axial direction of the toner supporter and it is made possible to suppress unevenness of pressure produced by the thickness regulation member.

Here, it is preferable that, the thickness regulation member abuts the toner supporter at a position where angle $\theta$ between a line connecting a roller axis center of the toner supporter and a roller axis center of the toner supply member and a line connecting the roller axis center of the toner supporter and a center of a contact part between the thickness regulation member and the toner supporter becomes 45 degrees$\leqq\theta<$90 degrees.

In the above configuration, the width of the non-abutment part at the tip of the thickness regulation member becomes furthermore uniform and it is made possible to more suppress unevenness of pressure produced by the thickness regulation member.

Preferably, the toner is supplied by the toner supply member from above a contact part between the toner supporter and the toner supply member in a developable state, and the thickness regulation member abuts the toner supporter below the contact part.

In the above configuration, toner is moved to the toner supply member and the toner supporter by gravitation and is supplied by the toner supply member and is supported on the toner supporter and then it is made possible to regulate the toner by the thickness regulation member, so that it is made possible to form a uniform toner layer unforcibly.

According to the present invention, there is also provided a developing device comprising:

a toner supporter, which supports toner;

a toner supply member, which is pressed against the toner supporter to supply the toner to the toner supporter;

a thickness regulation member, which regulates thickness of the toner supplied to the toner supporter by the toner supply member; and a support member, which supports the toner supporter and the toner supply member at both end sides so that the toner supporter and the toner supply member are urged in a direction of approaching each other, wherein the toner supply member is placed at ahead of the tip of the thickness regulation member in a direction in which the thickness regulation member extends, wherein the thickness regulation member is provided with a non-abutment part at a tip far from the abutment position against the toner supporter;

wherein the toner supporter is a roller comprised of metal;

wherein the toner supply member is a roller covered an outer peripheral portion thereof with an elastic material;

wherein the toner supporter and the toner supply member have outer peripheral parts in contact with each other;

wherein ends of the outer peripheral part of the toner supply member are placed inside ends of the outer peripheral part of the toner supporter;

wherein the thickness regulation member abuts the toner supporter at a position where angle θ between a line connecting a roller axis center of the toner supporter and a roller axis center of the toner supply member and a line connecting the roller axis center of the toner supporter and a center of a contact part between the thickness regulation member and the toner supporter becomes 45 degrees$\leqq\theta<$90 degrees;

wherein the toner is supplied by the toner supply member from above a contact part between the toner supporter and the toner supply member in a developable state; and wherein the thickness regulation member abuts the toner supporter below the contact part.

In the above configuration, the toner supply member and the toner supporter are urged in the direction of approaching each other and are abutted, whereby it is made possible to supply sufficient toner to the toner supporter. At this time, the toner supply member pressed against the toner supporter made of metal is made an elastic member, whereby while the toner supporter is protected, it is made possible to widen the abutment area of the toner supply member and the toner supporter for enhancing the toner supply property and the toner support property. The roller as the toner supporter and the roller as the toner supply member are supported in end parts and are urged in the support parts, whereby it is made possible to press the toner supply member in a state not affecting the toner layer.

On the other hand, deflection may occur in the toner supporter and the toner supply member urged in both end parts in the direction in which the axial centers are brought away from each other; particularly the toner supporter of a rigid body does not have a member for absorbing the press pressure like the elastic member of the toner supply member and thus there is a tendency to increase deflection. The thickness regulation member abutting the toner supporter varies in contact position and press pressure depending on what position the thickness regulation member abuts the toner supporter at in the circumferential direction of the toner supporter, largely affecting regulation of the thickness of the toner layer. For example, if the thickness regulation member is abutted against the toner supporter on the toner supply member side of the toner supporter so that the tip does not come in contact with the toner supporter, both end sides of the width of the noncontact part at the tip become narrow and the center becomes wide. If the thickness regulation member is abutted against the toner supporter on the opposite side to the toner supply member so that the tip does not come in contact with the toner supporter, both end sides of the width of the noncontact part at the tip become wide and the center becomes narrow. By the way, the noncontact part at the tip forms a gap with the toner supporter and the supplied toner and surplus toner occurring as the toner layer is evened by the thickness regulation member are accumulated in the gap. At this time, if the noncontact part is wide on the end part side of the thickness regulation member toner easily accumulates and the press pressure of the thickness regulation member is affected or there is a fear of the toner leaking to the outside of the developing unit. Thus, the abutment position of the thickness regulation member is placed on the toner supply member side, whereby it is made possible to well regulate the thickness of the toner layer.

Since the gap defined by the tip of the thickness regulation member and the toner supporter becomes the accumulation part of the supplied toner, the gap is placed downstream in the rotation directions of the toner supply member which rotates for supplying toner and the toner supporter for transporting toner, whereby it is made possible to reliably form a toner layer on the toner supporter. That is, the thickness regulation member abuts the toner supporter in the range of 90 degrees in the rotation direction of the toner supporter from the center of the contact position between the toner supporter and the toner supply member, whereby it is made possible to well regulate the thickness of the toner layer to form the toner layer.

Further, the thickness regulation member regulates the thickness of the toner layer on the toner supporter and also charges toner by friction. Thus, it is also important to urge so that the press pressure against the toner supporter becomes uniform in addition to the width of the noncontact part at the tip of the thickness regulation member. Thus, for example, as described above, when deflection occurs in the toner supporter, if the thickness regulation member is abutted against the toner supporter so that the line connecting the axis center of the toner supporter and the toner supply member and the thickness regulation member become parallel, the effect of the deflection is lessened and it is made possible to press the thickness regulation member against the toner supporter almost uniformly and as the abutment part of the toner supporter and the thickness regulation member approaches the abutment part of the toner supporter and the toner supply member, the press pressure in the center lowers. That is, to make uniform the width of the noncontact part at the tip of the thickness regulation member, it is desirable that the abutment part of the toner supporter and the thickness regulation member should be brought dose to the abutment part of the toner supporter and the toner supply member. To make uniform the press pressure of the thickness regulation member against the toner supporter, it is desirable that the thickness regulation member should be abutted against the toner supporter so that the line connecting the axis center of the toner supporter and the toner supply member and the thickness regulation member becomes parallel. Further, to provide the noncontact part at the tip of the thickness regulation member and define a gap by the thickness regulation member and the toner supporter, it is desirable that the abutment position of the thickness regulation member should be brought away from the abutment part of the toner supporter and the toner supply member and the thickness regulation member should be inclined relative to the tangent of the toner supporter in the abutment part of the toner supporter and the toner supply member.

Considering these points, the thickness regulation member is abutted against the toner supporter at the position where the angle θ between the connecting the roller axis center of the toner supporter and the roller axis center of the toner supply member and the line connecting the roller axis center of the toner supporter and the center of the contact part between the thickness regulation member and the toner supporter becomes 45 degrees$\leqq\theta<$90 degrees, whereby it is made possible to better regulate the thickness of the toner layer, press the thickness regulation member against the toner supporter almost uniformly, and suppress unevenness of the thickness of the toner layer and charge unevenness of toner for conducting good developing.

Further, to supply toner without opposing the pull of gravity, toner is supplied from above the toner supporter and the thickness regulation member is abutted against the toner supporter below the abutment part of the toner supporter and the toner supply member, whereby it is made possible to enhance the toner supply property.

According to the present invention, there is also provided an image formation apparatus comprising:

a developing device including:

a toner supporter, which supports toner;

a toner supply member, which is pressed against the toner supporter to supply the toner to the toner supporter; and a thickness regulation member, which regulates thickness of the toner supplied to the toner supporter by the toner supply member, wherein the thickness regulation member abuts the toner supporter on the toner supply member side of the toner supporter.

In the above configuration, the proper position of the thickness regulation member can be abutted against the toner supporter and unevenness of the pressure can also be suppressed, so that unevenness of the thickness of the toner layer and charge unevenness of toner can be suppressed and consequently it is made possible to form a high-quality image.

According to the present invention, there is also provided a computer system comprising:

a computer main unit; and an image formation apparatus, which is connected to the computer main unit, and the image formation apparatus including:

a developing device having:

a toner supporter, which supports toner;

a toner supply member, which is pressed against the toner supporter to supply the toner to the toner supporter; and a thickness regulation member, which regulates thickness of the toner supplied to the toner supporter by the toner supply member, wherein the thickness regulation member abuts the toner supporter on the toner supply member side of the toner supporter.

In the above configuration, the proper position of the thickness regulation member can be abutted against the toner supporter and unevenness of the pressure can also be suppressed, so that unevenness of the thickness of the toner layer and charge unevenness of toner can be suppressed and consequently it is made possible to form a high-quality image and it is made possible to provide an excellent computer system as compared with a related art computer system.

According to the present invention, there is also provided an developing device comprising:

a housing, which forms a toner storage section therein, and has a first end face and a second end face; and a roller support frame, which has a first side frame portion and a second side frame portion for supporting a rotation shaft of a developing roller at corresponding positions on inner sides of the first end face and the second end face of the housing, and the roller support frame being supported in the housing, and the roller support frame being formed of a material which has a smaller thermal expansion coefficient than a material of which the housing is formed, wherein the roller support frame is fixed integrally on the side of the second side frame portion so that a move of the roller support frame toward the second end face of the housing in a length direction of the rotation shaft of the developing roller is regulated; and wherein the roller support frame is configured on the side of the first side frame portion so that a relative move of the roller support frame toward the first end face of the housing in the length direction is allowed.

In the above configuration, since the material of which the housing of the developing cartridge is formed has a larger thermal expansion coefficient than the material of which the roller support frame is formed, expansion difference is produced between the housing and the roller support frame (the housing has a larger expansion amount) due to temperature change. However, on the side of the first side frame portion, a relative move of the roller support frame in the length direction to the first end face of the housing is not regulated and thus distortion of the roller support frame caused by the expansion difference between the housing and the roller support frame can be prevented. Therefore, the abutment pressure of the regulation blade against the peripheral surface of the developing roller placed in the roller support frame can be maintained continuously constant in the length direction of the regulation blade and thus it is made possible to supply toner evenly in the length direction.

Preferably, the first side frame portion is formed with an unloaded hole having an inner diameter larger than a diameter of a first screw. The second side frame portion is formed with a screw hole into which a second screw is screwed. The first end face is formed with a screw hole into which the first screw is screwed at a position corresponding to the unloaded hole. The second end face is formed with an unloaded hole having an inner diameter larger than a diameter of the second screw at a position corresponding to the screw hole formed in the second side frame portion. The first screw is screwed into the hole formed in the first end face and pierces the unloaded hole formed in the first side frame portion. The second screw pierces the unloaded hole formed in the second end face and is screwed into the hole formed in the second side frame portion.

In the above configuration, the abutment pressure of the regulation blade against the peripheral surface of the developing roller placed in the roller support frame can be maintained continuously constant in the length direction of the regulation blade and thus it is made possible to supply toner evenly in the length direction.

Here, it is preferable that, the roller support frame supports both end parts of the rotation shaft of the developing roller for rotation through shaft retention members, and the second side frame portion is fastened by the second screw in such a manner that the second end face of the housing is sandwiched between the second side frame portion and the shaft retention member.

In the above configuration, on the side of the second side frame portion of the roller support frame, the roller support frame is fastened by the second screw in such a manner that the second end face of the housing is sandwiched between the second side frame portion and the shaft retention member, and is integrally fixed so that a move of the roller support frame in the length direction to the second end face of the housing is regulated, whereby on the side of the first side frame portion, the roller support frame can make a relative move in the length direction to the first end face of the housing, and distortion of the roller support frame caused by the expansion difference between the housing and the roller support frame can be prevented. Therefore, the abutment pressure of the regulation blade against the peripheral surface of the developing roller placed in the roller support frame can be maintained continuously constant in the length direction of the regulation blade and thus it is made possible to supply toner evenly in the length direction.

Preferably, the first end face and the first side frame portion are formed with at least two screw holes and unloaded holes at corresponding positions, and the second end face and the second side frame portion are formed with at least two unloaded holes and screw holes at corresponding positions.

In the above configuration, at least two screw holes and unloaded holes are made at the corresponding positions, so that the roller support frame can be reliably fixed to the housing.

Preferably, a gap is formed between the first end face of the housing and the first side frame portion of the roller support frame so that a slight gap is formed therebetween in a state that the housing is most contracted.

In the above configuration, if the housing having a larger thermal expansion coefficient is most contracted in an assumed usual operating environment, the end face of the housing can abut the side frame portion of the roller support frame for reliably preventing distortion of the roller support frame.

Preferably, the roller support frame is provided with a regulation blade for evening toner deposited on a peripheral surface of the developing roller.

In the above configuration, unless the roller support frame becomes deformed, the abutment pressure of the regulation blade against the peripheral surface of the developing roller can be maintained continuously constant in the length direction of the regulation blade. Therefore, it is made possible to maintain even toner supply in the length direction.

According to the present invention, there is also provided an image formation apparatus comprising;

a developing device including:

a housing, which has a first end face and a second end face, and the housing forming a toner storage section therein; and a roller support frame, which has a first side frame portion and a second side frame portion for supporting a rotation shaft of a developing roller at corresponding positions on inner sides of the first end face and the second end face of the housing, and the roller support frame being supported in the housing, and the roller support frame being formed of a material having a smaller thermal expansion coefficient than a material of which the housing is formed, wherein the roller support frame is fixed integrally on the side of the second side frame portion so that a move of the roller support frame toward the second end face of the housing in a length direction of the rotation shaft of the developing roller is regulated; and wherein the roller support frame is configured on the side of the first side frame portion so that a relative move of the roller support frame toward the first end face of the housing in a length direction of the rotation shaft of the developing roller is allowed.

In the above configuration, the abutment pressure of the regulation blade against the peripheral surface of the developing roller can be maintained continuously constant in the length direction of the regulation blade and therefore the toner supply state always becomes constant and print of good quality can be accomplished.

According to the present invention, there is also provided a developing device comprising:

a housing, which forms a toner storage section therein; and a roller support frame, which supports a rotation shaft of a developing roller, and is supported in the housing, and the roller support frame including:

a first side frame portion and a second side frame portion, which supports the rotation shaft of the developing roller;

a lower frame portion, which is connected to both the first and second side frame portions at the bottoms thereof, and supports a regulation blade which abuts a peripheral surface of the developing roller for evening toner deposited on the peripheral surface; and an upper frame portion, which is connected to both the first and second side frame portions at the tops of the first and second side frame portions, and wherein both the first and second side frame portions, the lower frame portion and the upper frame portion form a closed loop structure and support the developing roller and the regulation blade as a unit.

In the above configuration, the closed loop structure is adopted, whereby the shape retention of the roller support frame is enhanced, making it hard to deform the roller support frame by the force exerted when the developing cartridge is placed or removed. The regulation blade needs to be uniformly pressed against the peripheral surface of the developing roller in the length direction thereof. As the roller support frame is hard to become deformed as described above, the relationship between the regulation blade and the peripheral surface of the developing roller is maintained continuously. Therefore, any desired toner evening effect can be provided appropriately and inconsistencies in toner density on the developing roller become hard to occur.

Preferably, both the first and second side frame portions and the lower frame portion are molded in one piece.

In the above configuration, both the side frame portions and the lower frame portion can be worked in one piece and are manufactured easily.

Preferably, the upper frame portion is fixed with both the side frame portions by screws.

In the above configuration, the upper frame portion can be added to a related art structure made up of only both side frame portions and a lower frame portion and in addition, only the upper frame portion is later connected additionally, so that the assembling step of the roller support frame is facilitated.

Preferably, the roller support frame is formed of a material having a smaller thermal expansion coefficient than a material of which the housing is formed. The housing has a first end face and a second end face, and the first side frame portion and the second side frame portion are placed at corresponding positions on inner sides of the first end face and the second end face of the housing. The roller support frame is fixed integrally on the side of the second side frame portion so that a move of the roller support frame toward the second end face of the housing in a length direction of the rotation shaft of the developing roller is regulated. The roller support frame is configured on the side of the first side frame portion so that a relative move of the roller support frame toward the first end face of the housing in a length direction of the rotation shaft of the developing roller is allowed.

In the above configuration, since the material of which the housing of the developing cartridge is formed has a larger thermal expansion coefficient than the material of which the roller support frame is formed, expansion difference is produced between the housing and the roller support frame (the housing has a larger expansion amount) due to temperature change. However, according to the described configuration, on the side of the first side frame portion, a relative move of the roller support frame in the length direction to the first end face of the housing is not regulated and thus distortion of the roller support frame caused by the expansion difference between the housing and the roller support frame can be prevented. Therefore, according to the invention, the abutment pressure of the regulation blade against the peripheral surface of the developing roller placed in the roller support frame can be maintained continuously constant in the length direction of the regulation blade and thus it is made possible to supply toner evenly in the length direction.

Here, it is preferable that, the first side frame portion is formed with an unloaded hole having an inner diameter larger than a diameter of a first screw. The second side frame portion is formed with a screw hole into which a second screw is screwed. The first end face is formed with a screw hole into which the first screw is screwed at a position corresponding to the unloaded hole. The second end face is formed with an unloaded hole having an inner diameter larger than a diameter of the second screw at a position corresponding to the screw hole formed in the second side frame portion. The first screw is screwed into the hole formed in the first end face and pierces the unloaded hole formed in the first side frame portion. The second screw pierces the unloaded hole formed in the second end face and is screwed into the hole formed in the second side frame portion.

In the above configuration, the abutment pressure of the regulation blade against the peripheral surface of the developing roller placed in the roller support frame can be maintained continuously constant in the length direction of the regulation blade and thus it is made possible to supply toner evenly in the length direction.

Here, it is preferable that, the roller support frame supports both end parts of the shaft of the developing roller for rotation through shaft retention members, and the second side frame portion is fastened by the second screw in such a manner that the second end face of the housing is sandwiched between the second side frame portion and the shaft retention member.

In the above configuration, on the side of the second side frame portion of the roller support frame, the roller support frame is fastened by the second screw in such a manner that the second end face of the housing is sandwiched between the second side frame portion and the shaft retention member, and is integrally fixed so that a move of the roller support frame in the length direction to the second end face of the housing is regulated, whereby on the side of the first side frame portion, the roller support frame can make a relative move in the length direction to the first end face of the housing, and distortion of the roller support frame caused by the expansion difference between the housing and the roller support frame can be prevented. Therefore, the abutment pressure of the regulation blade against the peripheral surface of the developing roller placed in the roller support frame can be maintained continuously constant in the length direction of the regulation blade and thus it is made possible to supply toner evenly in the length direction.

According to the present invention, there is also provided a rotary developing unit comprising:

a plurality of developing device, each including:

a housing, which forms a toner storage section therein; and a roller support frame, which supports a rotation shaft of a developing roller, and being supported in the housing, and the roller support frame including:

a first side frame portion and a second side frame portion for supporting the rotation shaft of the developing roller;

a lower frame portion, which is connected to both the first and second side frame portions at the bottoms thereof, and supports a regulation blade which abuts a peripheral surface of the developing roller for evening toner deposited on the peripheral surface, and an upper frame portion, which is connected to both the first and second side frame portions at the tops of the first and second side frame portions, wherein both the first and second side frame portions, the lower frame portion and the upper frame portion form a closed loop structure and support the developing roller and the regulation blade as a unit; and wherein the plurality of developing devices are placed so as to rotate around a rotation shaft of the rotary developing unit.

In the above configuration, the operation of rotating the rotary developing unit on the rotation shaft thereof for bringing the developing cartridge of any desired color adjacent to the photoconductor drum for developing is repeated with a plurality of developing cartridges, whereby toner color images are formed on the photoconductor drum and color print can be executed. At the time, it is hard to deform the roller support frame by the external force exerted when the developing cartridge is placed in or removed from the rotary developing unit, so that the relationship between the regulation blade and the peripheral surface of the developing roller is maintained, any desired toner evening effect can be provided appropriately, and inconsistencies in toner density on the developing roller become hard to occur.

According to the present invention, there is also provided an image formation apparatus comprising:

a rotary developing unit including:

a plurality of developing device, each having:

a housing, which forms a toner storage section therein; and a roller support frame, which supports a rotation shaft of a developing roller, and is supported in the housing, and the roller support frame including:

a first side frame portion and a second side frame portion for supporting the rotation shaft;

a lower frame portion which is connected to both the first and second side frame portions at the bottoms thereof, and supports a regulation blade which abuts a peripheral surface of the developing roller for evening toner deposited on the peripheral surface; and an upper frame portion, which is connected to both the first and second side frame portions at the tops of the first and second side frame portions, and wherein both the first and second side frame portions, the lower frame portion and the upper frame portion form a closed loop structure and support the developing roller and the regulation blade as a unit; and wherein the plurality of developing devices are placed so as to rotate around a rotation shaft of the rotary developing unit.

In the above configuration, the relationship between the regulation blade and the peripheral surface of the developing roller is maintained, any desired toner evening effect can be provided appropriately, and inconsistencies in toner density on the developing roller become hard to occur.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

[Outline of Image Formation Apparatus (Laser Beam Printer)]

Figure 1:
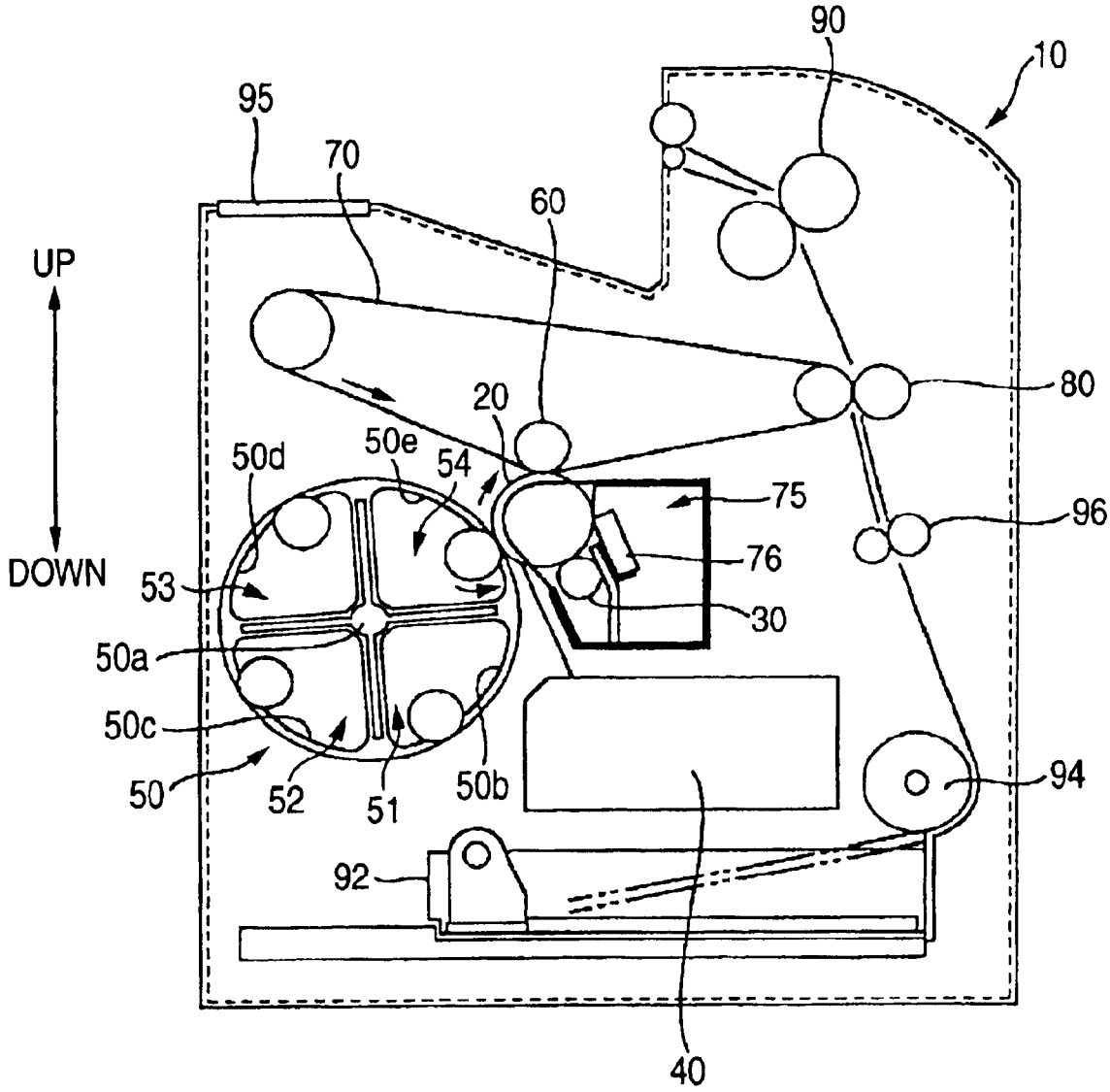
FIG. 1 is a drawing to show the main components making up an image formation apparatus according to a first embodiment of the invention.

An outline of an image formation apparatus having a developing device will be discussed with FIG. 1 by taking a laser beam printer (hereinafter, printer) 10 as an example. FIG. 1 is a drawing to show the main components making up the printer 10 according to the first embodiment of the invention. In FIG. 1, the up and down direction is indicted by an arrow; for example, a paper feed tray 92 is placed in a lower part of the printer 10 and a fixing unit 90 is placed in an upper part of the printer 10.

As shown in FIG. 1, the printer 10 according to the embodiment has a charging unit 30, a light exposure unit 40, a Rotary developing unit 50, a primary transfer unit 60, an intermediate transfer body 70, and a cleaning unit 75 along the rotation direction of a photoconductor 20 of a latent image support for supporting a latent image, and further has a secondary transfer unit 80, the fixing unit 90, a display unit 95 made of a liquid display panel as user information member, and a control unit 100 (FIG. 2) for controlling the units, etc., for governing the operation as the printer.

The photoconductor 20 has a conductive base material shaped like a cylinder and a photoconductive layer formed on the outer peripheral surface of the conductive base material and can rotate on a center axis. The photoconductor 20 rotates clockwise as indicated by the arrow in FIG. 1.

The charging unit 30 is a unit for charging the photoconductor 20. The light exposure unit 40 is a unit for forming a latent image on the photoconductor 20 charged by application of a laser. The light exposure unit 40 has a semiconductor laser, a polygon mirror, an F-θ lens, etc., and applies a modulated laser onto the charged photoconductor 20 based on an image signal input from a host computer such as a personal computer or a word processor (not shown).

The Rotary developing unit 50 is a device for developing the latent image formed on the photoconductor 20 with black (K) toner, magenta (M) toner, cyan (C) toner, and yellow (Y) toner. These toners are stored in a black developing device 51, a magenta developing device 52, a cyan developing device 53, and a yellow developing device 54 contained in the Rotary developing unit 50.

In the embodiment, as the Rotary developing unit 50 rotates, the positions of the four developing devices 51, 52, 53, and 54 can be moved. That is, the Rotary developing unit 50 retains the four developing devices 51, 52, 53, and 54 by four retention parts 50*b*, 50*c*, 50*d*, and 50*e*, and the four developing devices 51, 52, 53, and 54 can rotate on a center axis 50*a* with their relative positions maintained. The developing devices 51, 52, 53, and 54 corresponding to the latent image formed on the photoconductor 20 are selectively opposed to the photoconductor 20 for developing the latent image formed on the photoconductor 20 in the toners stored in the developing devices 51, 52, 53, and 54. The developing devices are described below in detail.

The primary transfer unit 60 is a unit for transferring a single-color toner image formed on the photoconductor 20 to the intermediate transfer body 70. When four color toners are transferred and superposed on each other in order, a full-color toner image is formed on the intermediate transfer body 70. The intermediate transfer body 70 is an endless belt and is rotated at almost the same circumferential speed as the photoconductor 20. The secondary transfer unit 80 is a unit for transferring the single-color toner image or the full-color toner image formed on the intermediate transfer body 70 to a record medium such as paper, a film, or a cloth.

The fixing unit 90 is a unit for fusing the single-color toner image or the full-color toner image transferred onto the record medium of paper, etc., to form a permanent image.

The cleaning unit 75 is placed between the primary transfer unit 60 and the charging unit 30 and has a cleaning blade 76 made of rubber abutted against the surface of the photoconductor 20. It is a unit for scraping and removing the remaining toner on the photoconductor 20 by the cleaning blade 76.

Figure 2:
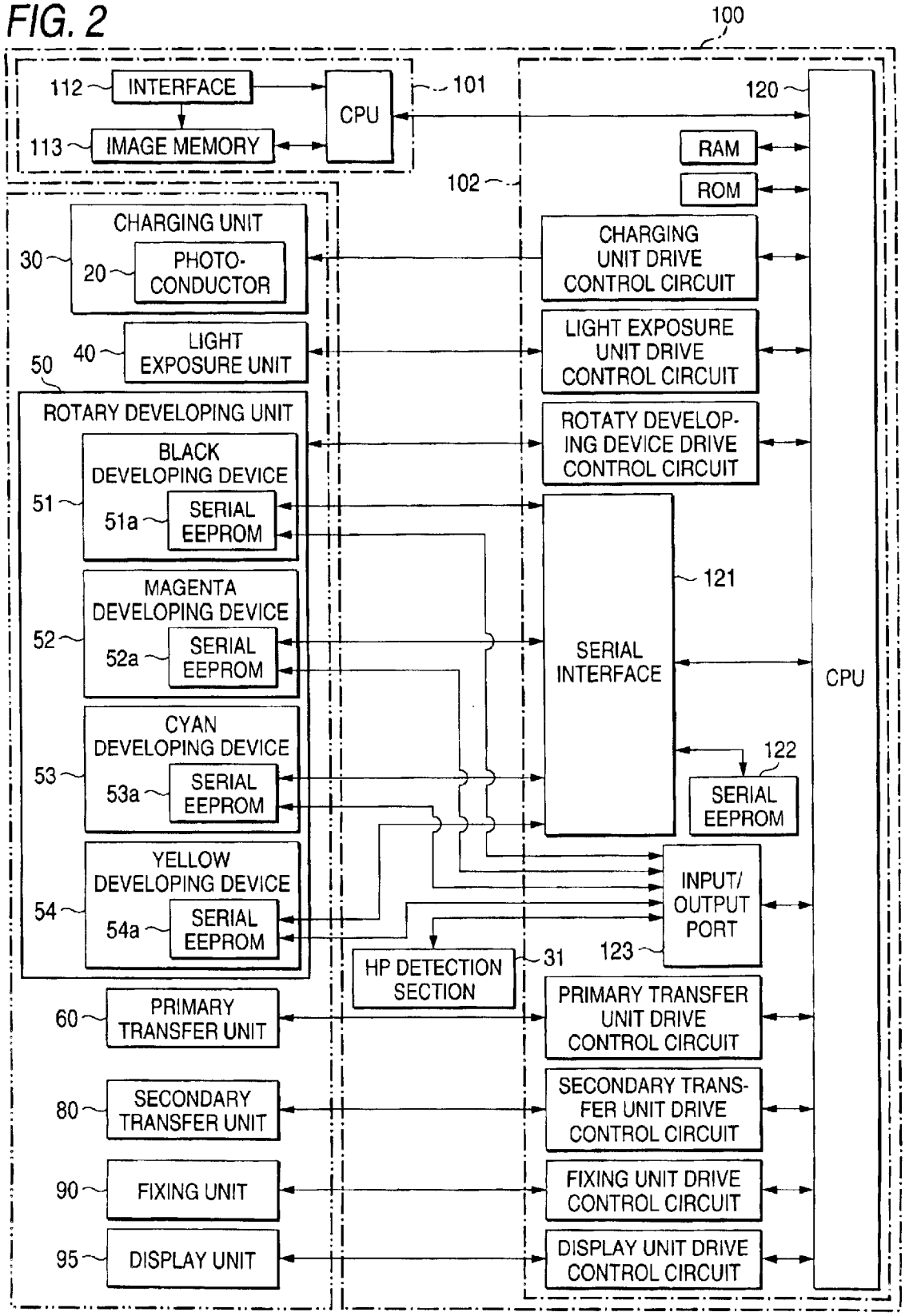
FIG. 2 is a block diagram to show a control unit of the image formation apparatus in FIG. 1.

The control unit 100 is made up of a main controller 101 and a unit controller 102 as shown in FIG. 2. An image signal is input to the main controller 101 and the unit controller 102 controls the units, etc, for forming an image in response to a command based on the image signal.

[Operation of Printer 10]

Next, the operation of the described printer 10 will be discussed also making mention of other components.

When an image signal from the host computer (not shown) is input through an interface (I/F) 112 to the main controller 101 of the printer 10, the photoconductor 20, a developing roller 510 (FIG. 3) as a toner supporter placed in the developing device, and the intermediate transfer body 70 rotate under the control of the unit controller 102 based on a command from the main controller 101. While the photoconductor 20 is rotated, it is charged in order at a charging position by the charging unit 30.

At this time, the charged area of the photoconductor 20 reaches a light exposure position with rotation of the photoconductor 20, and a latent image responsive to image information of the first color, for example, yellow Y is formed in the area by the light exposure unit 40. The yellow developing device 54 storing yellow (Y) toner, contained in the Rotary developing unit 50 is at a developing position opposed to the photoconductor 20.

The latent image formed on the photoconductor 20 reaches the developing position with rotation of the photoconductor 20 and is developed in the yellow toner by the yellow developing device 54, whereby a yellow toner image is formed on the photoconductor 20.

The yellow toner image formed on the photoconductor 20 reaches a primary transfer position with rotation of the photoconductor 20 and is transferred to the intermediate transfer body 70 by the primary transfer unit 60. At this time, a primary transfer voltage of the opposite polarity to the toner charge polarity is applied to the primary transfer unit 60. Meanwhile, the secondary transfer unit 80 is away from the intermediate transfer body 70.

This process is repeated for the second color, the third color, and the fourth color, whereby the color toner images corresponding to the image signals are transferred to the intermediate transfer body 70 as they are superposed on each other. Accordingly, a full-color toner image is formed on the intermediate transfer body 70.

The full-color toner image formed on the intermediate transfer body 70 reaches a secondary transfer position with rotation of the intermediate transfer body 70 and is transferred to a record medium by the secondary transfer unit 80. The record medium is transported from the paper feed tray 92 via a paper feed roller 94 and a registration roller 96 to the secondary transfer unit 80. When the transfer operation is performed, the secondary transfer unit 80 is pressed against the intermediate transfer body 70 and a secondary transfer voltage is applied to the secondary transfer unit 80.

The full-color toner image transferred to the record medium is heated and pressurized by the fixing unit 90 and is fused to the record medium.

On the other hand, after the photoconductor 20 passes through the primary transfer position, the toner deposited on the surface of the photoconductor 20 is scraped off by the cleaning blade 76 of the cleaning unit 75 for charging to form another latent image. The scraped toner is collected into a remaining toner collection section contained in the cleaning unit 75.

[Outline of Control Unit]

Next, the configuration of the control unit 100 will be discussed with reference to FIG. 2. The main controller 101 of the control unit 100 is connected to the host computer through the interface 112 and includes image memory 113 for storing the image signal input from the host computer. The unit controller 102 is electrically connected to the units of the apparatus main unit (charging unit 30, light exposure unit 40, primary transfer unit 60, cleaning unit 75, secondary transfer unit 80, fixing unit 90, and display unit 95) and the Rotary developing unit 50. Upon reception of signals from sensors contained in the units, etc., the unit controller 102 detects the state of each of the units and the Rotary developing unit 50 and controls the units and the Rotary developing unit 50 based on a signal input from the main controller 101.

A CPU 120 contained in the unit controller 102 is connected to a nonvolatile storage element 122 such as serial EEPROM, which will be hereinafter referred to as main unit memory, through a serial interface (I/F) 121. The CPU 120 is connected not only to the main unit memory 122, but also to developing device memory 51*a*, 52*a*, 53*a*, and 54*a* placed in the developing devices 51, 52, 53, and 54 through the serial interface 121, so that data transfer is made possible between the main unit memory 122 and the developing device memory 51*a*, 52*a*, 53*a*, and 54*a*, and a chip select signal CS can be input to each developing device memory 51*a*, 52*a*, 53*a*, 54*a* through an input/output port 123. Further, the CPU 120 is also connected to an HP detection section 31 through the input/output port 123.

[Outline of Developing Devices]

Figure 3:
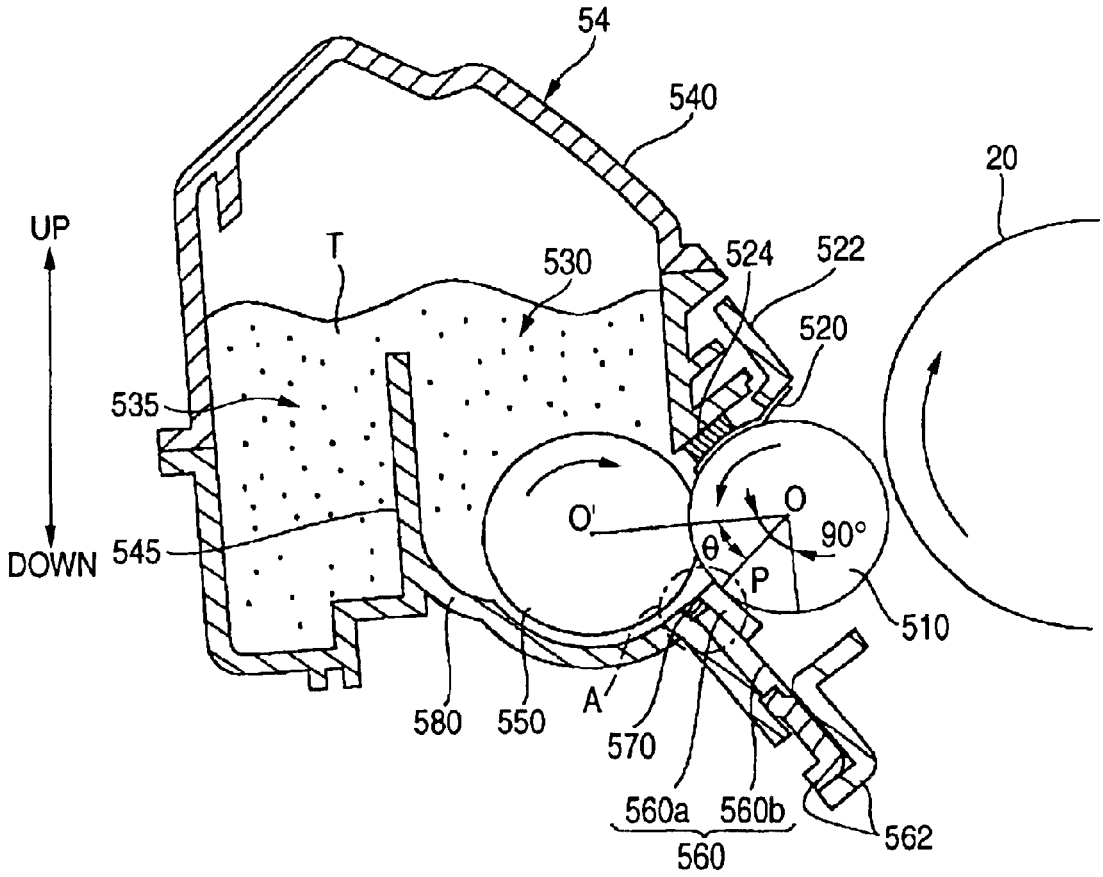
FIG. 3 is a drawing to describe the operation of a developing device.

Next, an outline of the developing devices will be discussed with reference to FIG. 3. FIG. 3 is a sectional view to show the main components of the yellow developing device. In FIG. 3, the up and down direction is also indicted by an arrow as in FIG. 1; for example, the center axis of the developing roller 510 is placed below the center axis of the photoconductor 20. In FIG. 3, the yellow developing device 54 is shown in a state in which it is at the developing position opposed to the photoconductor 20.

The Rotary developing unit 50 includes the black developing device 51 storing black (K) toner, the magenta developing device 52 storing magenta (M) toner, the cyan developing device 53 storing cyan (C) toner, and the yellow developing device 54 storing yellow (Y) toner. The developing devices have similar configurations and therefore the yellow developing device 54 will be discussed.

The yellow developing device 54 has the developing roller 510 as a toner supporter, a seal member 520, a first storage section 530, a second storage section 535, a frame 540, a regulation wall 545, a toner supply roller 550 as a toner supply member, a regulation blade 560 as a thickness regulation member, and a blade back member 570 for urging the regulation blade 560.

The developing roller 510 supports and transports toner T to the developing position opposed to the photoconductor 20. It is formed of aluminum, stainless steel, iron, etc., and is plated with nickel, chrome, etc., as required. The developing roller 510 can rotate on the center axis and rotates in the opposite direction (counterclockwise in FIG. 3) to the rotation direction of the photoconductor 20 (clockwise in FIG. 3) as shown in FIG. 3. The center axis of the developing roller 510 is placed below the center axis of the photoconductor 20. As shown in FIG. 3, a gap exists between the developing roller 510 and the photoconductor 20 in a state in which the yellow developing device 54 is opposed to the photoconductor 20. That is, the yellow developing device 54 develops the latent image formed on the photoconductor 20 in a noncontact state. To develop the latent image formed on the photoconductor 20, an alternating electric field is formed between the developing roller 510 and the photoconductor 20.

The seal member 520 prevents the toner T in the yellow developing device 54 from leaking to the outside of the developing device, and collects the toner T on the developing roller 510 passing through the developing position into the developing device without scraping. The seal member 520 is a seal made of a polyethylene film, etc. It is supported by a seal support metal sheet 522 and is attached to the frame 540 through the seal support metal sheet 522. A seal urging member 524 made of a malt plain, etc., is placed on the opposite side of the seal member 520 to the developing roller 510, and the seal member 520 is pressed against the developing roller 510 by the elastic force of the seal urging member 524. The abutment position of the seal member 520 against the developing roller 510 is above the center axis of the developing roller 510.

The first storage section 530 and the second storage section 535 for storing toner T are defined by a part of the frame 540. The frame 540 has the regulation wall 545 for regulating a move of the toner T between the first storage section 530 and the second storage section 535. The regulation wall 545 extends upward from the bottom of the frame 540 (in the up-and-down direction in FIG. 3) and has an upper end positioned above the uppermost position of the toner supply roller 550. An agitation member for agitating the toner T stored in the first storage section 530 and the second storage section 535 may be provided. In the embodiment, however, the developing devices (black developing device 51, magenta developing device 52, cyan developing device 53, and yellow developing device 54) rotate with rotation of the Rotary developing unit 50, whereby the toner T in each developing device is agitated and therefore the first storage section 530 and the second storage section 535 are provided with no agitation member.

The toner supply roller 550 supplies the toner T stored in the first storage section 530 and the second storage section 535 to the developing roller 510. The toner supply roller 550 which is made of polyurethane, etc, has a metal shaft. It is supported at both end parts by bearings placed in the frame 540 together with the developing roller 510. The bearings of the toner supply roller 550 and the developing roller 510 are placed so that the axis-to-axis distance is narrower than the distance of the sum of the radiuses, and the toner supply roller 550 is abutted against the developing roller 510 as it is elastically deformed. The toner supply roller 550 is formed so that the end parts of the outer peripheral portion abutted against the developing roller 510 are placed at the inside of the end parts of the outer peripheral portion of the developing roller 510; supply of the toner T to the end parts of the developing roller 510 is suppressed and occurrence of surplus toner T is suppressed, thereby preventing the toner T from scattering to the outside The toner supply roller 550 is placed in a lower part of the first storage section 530, and the toner T stored in the first storage section 530 and the second storage section 535 is supplied to the developing roller 510 by the toner supply roller 550 in a lower part of the first storage section 530. The toner supply roller 550 can rotate on the center axis and the center axis of the toner supply roller 550 is placed below the rotation center axis of the developing roller 510 The toner supply roller 550 rotates in the opposite direction (clockwise in FIG. 3) to the rotation direction of the developing roller 510 (counterclockwise in FIG. 3). The toner supply roller 550 has not only the function of supplying the toner T stored in the first storage section 530 and the second storage section 535 to the developing roller 510, but also a function of scraping the remaining toner T on the developing roller 510 after developing from the developing roller 510.

The regulation blade 560 as a thickness regulation member regulates the thickness of the toner T supported on the developing roller 510 and charges the toner T supported on the developing roller 510. The regulation blade 560 has a rubber part 560*a* and a rubber support part 560*b*. The rubber part 560*a* is made of silicone rubber, urethane rubber, etc., and the rubber support part 560*b* is a thin plate of phosphor bronze, stainless steel, etc., having a spring property. The rubber part 560*a* is supported by the rubber support part 560*b*. The rubber support part 560*b* is attached to the frame 540 via a pair of blade support metal sheets 562 in a state in which one end part of the rubber support part 560*b* is sandwiched between the blade support metal sheets 562 for support. The blade back member 570 made of a malt plain, etc., is placed on the opposite side of the regulation blade 560 to the developing roller 510.

The rubber part 560*a* is pressed against the developing roller 510 by the elastic force produced by deflection of the rubber support part 560*b*. The blade back member 570 prevents the toner T from entering space between the rubber support part 560*b* and the frame 540 for stabilizing the elastic force produced by deflection of the rubber support part 560*b*, and also urges the rubber part 560*a* in the direction of the developing roller 510 just from the back of the rubber part 560*a*, thereby pressing the rubber part 560*a* against the developing roller 510. Therefore, the blade back member 570 improves the uniform abutment property of the rubber part 560*a* against the developing roller 510.

Figure 4:
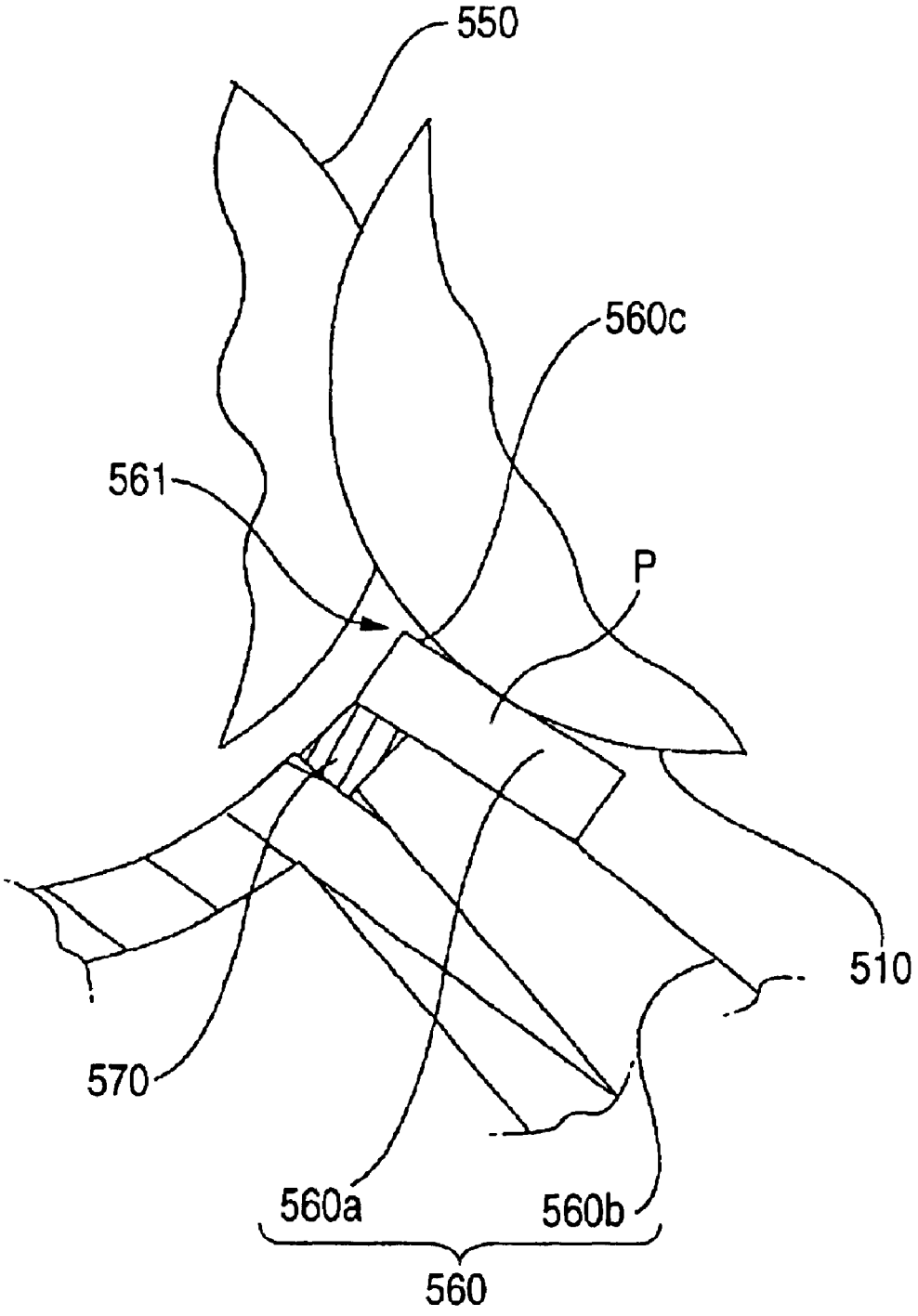
FIG. 4 is an enlarged view of A part shown in FIG. 3.

The end of the regulation blade 560 on the opposite side to the side of the regulation blade 560 supported by the blade support metal sheets 562, namely, the tip of the regulation blade 560 is not in contact with the developing roller 510 as shown in FIG. 4, and the portion at a predetermined distance from the tip is in contact with the developing roller 510 with a width. That is, the regulation blade 560 abuts the developing roller 510 on a middle section rather than at edges. The regulation blade 560 counter-abuts and is placed so that the tip is directed upstream in the rotation direction of the developing roller 510 and in the direction of the toner supply roller 550. The abutment position of the regulation blade 560 against the developing roller 510 is below the center axis of the developing roller 510 and below the center axis of the toner supply roller 550.

The frame 540 is manufactured by joining a plurality of frames molded in one piece (upper frame, lower frame, etc.) and has an opening at the bottom. A part of the developing roller 510 is exposed axially to the opening.

In the described yellow developing device 54, the toner supply roller 550 supplies the toner T stored in the first storage section 530 and the second storage section 535 to the developing roller 510. The supplied toner T is supported on the developing roller 510 and reaches the abutment position of the regulation blade 560 with rotation of the developing roller 510. When the toner T passes through the abutment position, the thickness of the toner T is regulated and the toner T is charged. The toner T whose thickness is regulated on the developing roller 510 reaches the developing position opposed to the photoconductor 20 with further rotation of the developing roller 510, and is provided for developing the latent image formed on the photoconductor 20 under an alternating electric field at the developing position. The toner remaining on the developing roller 510 passing through the developing position with further rotation of the developing roller 510 passes through the seal member 520 and is collected into the developing device without being scraped by the seal member 520.

[Effect of Placement of Regulation Blade on Image]

Figure 5:
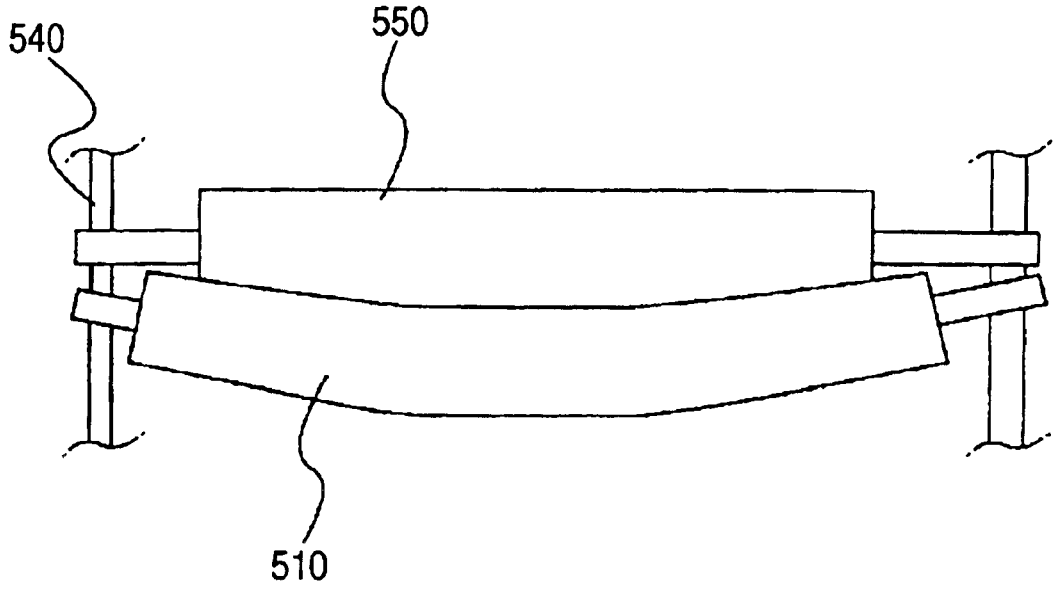
FIG. 5 is a conceptual drawing to show the urging state between a developing roller and a toner supply roller.

Next, the function of the regulation blade in the developing device will be discussed with FIGS. 3 to 5. FIG. 4 is an enlarged view of A part in FIG. 3, and FIG. 5 is a conceptual drawing to show the urging state between the developing roller 510 and the toner supply roller 550.

The toner supply roller 550 and the developing roller 510 are urged in the direction of approaching each other. As shown in FIG. 3, the toner supply roller 550 is elastically deformed and abuts the developing roller 510. The toner T is pressed by the toner supply roller 550 from above the developing roller 510 and is supplied. The pressed and supplied toner T is supported on the developing roller 510 which rotates, and is moved to the developing position as the developing roller 510 rotates. The regulation blade 560 has the rubber part 560*a* pressed against the developing roller 510 by the elastic force produced by deflection of the rubber support part 560*b* and compression of the blade back member 570 downstream in the rotation direction of the developing roller 510. In the embodiment, the regulation blade 560 is abutted against the developing roller 510 at a position where angle θ between the line connecting axis center O of the developing roller 510 and axis center O' of the toner supply roller 550 and the line connecting the axis center O of the developing roller 510 and contact part center P of the rubber part 560*a* with the developing roller 510 becomes about 45 degrees. The regulation blade 560 is formed at the tip with a non-abutment part 560*c* which does not come in contact with the developing roller 510, and the non-abutment part 560*c* and the developing roller 510 form a gap 561. When the toner T supported on the developing roller 510 is evened almost uniformly by the regulation blade 560, surplus toner T is accumulated in the gap 561; when shortage of toner T occurs, the toner T accumulated in the gap 561 is supplied.

By the way, the developing roller 510 made of metal and the toner supply roller 550 made of polyurethane foam are pressed as they are supported by the frame 540, and thus deflection occurs in the developing roller 510 as described above. To prevent the toner T from leaking to the outside, as shown in FIG. 5, if the ends of the outer periphery of the toner supply roller 550 are placed at the inside of the ends of the outer periphery of the developing roller 510, deflection becomes larger. To suppress unevenness of the thickness and unevenness of the press pressure of the regulation blade 560 caused by the deflection, the abutment position of the regulation blade 560 against the developing roller 510 is the position where the angle θ becomes 45 degrees (shown in FIG. 3).

A detailed description is described as follows. To suppress unevenness of the thickness, it is ideal to abut the regulation blade 560 against the developing roller 510 at a position where the width of the non-abutment part 560*c* at the tip of the regulation blade 560 becomes uniform throughout the axial area. For example, when deflection occurs in the developing roller 510 as described above, if the regulation blade 560 is placed at a position where the deflection direction of the developing roller 510 and the regulation blade 560 become parallel, namely, the angle θ becomes 90 degrees, both axial ends of the width of the non-abutment part 560*c* at the tip of the regulation blade 560 become narrow and the center becomes wide. Thus, surplus toner T is gathered at the center and the toner T at both ends lessens; it is feared that the thickness of the toner on the developing roller 510 will not become uniform. On the other hand, although deflection occurs in the developing roller 510, if the regulation blade 560 is placed on the side near to the abutment part of the developing roller 510 and the toner supply roller 550, namely, the side where the toner supply roller 550 presses, the developing roller 510 abuts along the developing roller 510 where deflection occurs, so that the width of the non-abutment part 560*c* at the tip of the regulation blade 560 becomes almost uniform. Thus, to make the width of the non-abutment part 560*c* uniform, the side near to the abutment part of the developing roller 510 and the toner supply roller 550 with the toner supply roller 550 avoided becomes the ideal position of the regulation blade 560.

On the other hand, to make the press force of the regulation blade 560 uniform throughout the axial area, it is desirable that the regulation blade 560 should be abutted against the developing roller 510 with the rubber part 560*a* maintained plane. Thus, the position where the deflection direction of the developing roller 510 and the regulation blade 560 become parallel, namely, the angle θ becomes 90 degrees is ideal. As the position shifts away from the ideal position, the effect of deflection of the developing roller 510 is increased and unevenness occurs in the press force of the regulation blade 560.

In the two conditions, the higher effect degree as developing condition is the width of the non-abutment part 560*c* at the tip of the regulation blade 560. Thus, the regulation blade 560 is abutted against the developing roller 510 at the position where the angle θ becomes about 45 degrees as a position near to the abutment part of the developing roller 510 and the toner supply roller 550 while the non-abutment part 560*c* against the developing roller 510 is provided at the tip of the regulation blade 560. As such placement is adopted, if deflection occurs in the developing roller 510, it is made possible to well regulate the thickness and press the regulation blade 560 against the developing roller 510 almost uniformly for suppressing unevenness of the thickness and charge unevenness of toner and conducting good developing.

Further, it is made possible to maintain the configuration to conduct better developing in such a manner that the developing roller 510 made of metal and the toner supply roller 550 made of polyurethane foam for providing a good toner supply property are used and that the support parts at both ends capable of urging the toner supply roller 550 and the developing roller 510 at outside of the toner layer formation area are used.

Figure 9:
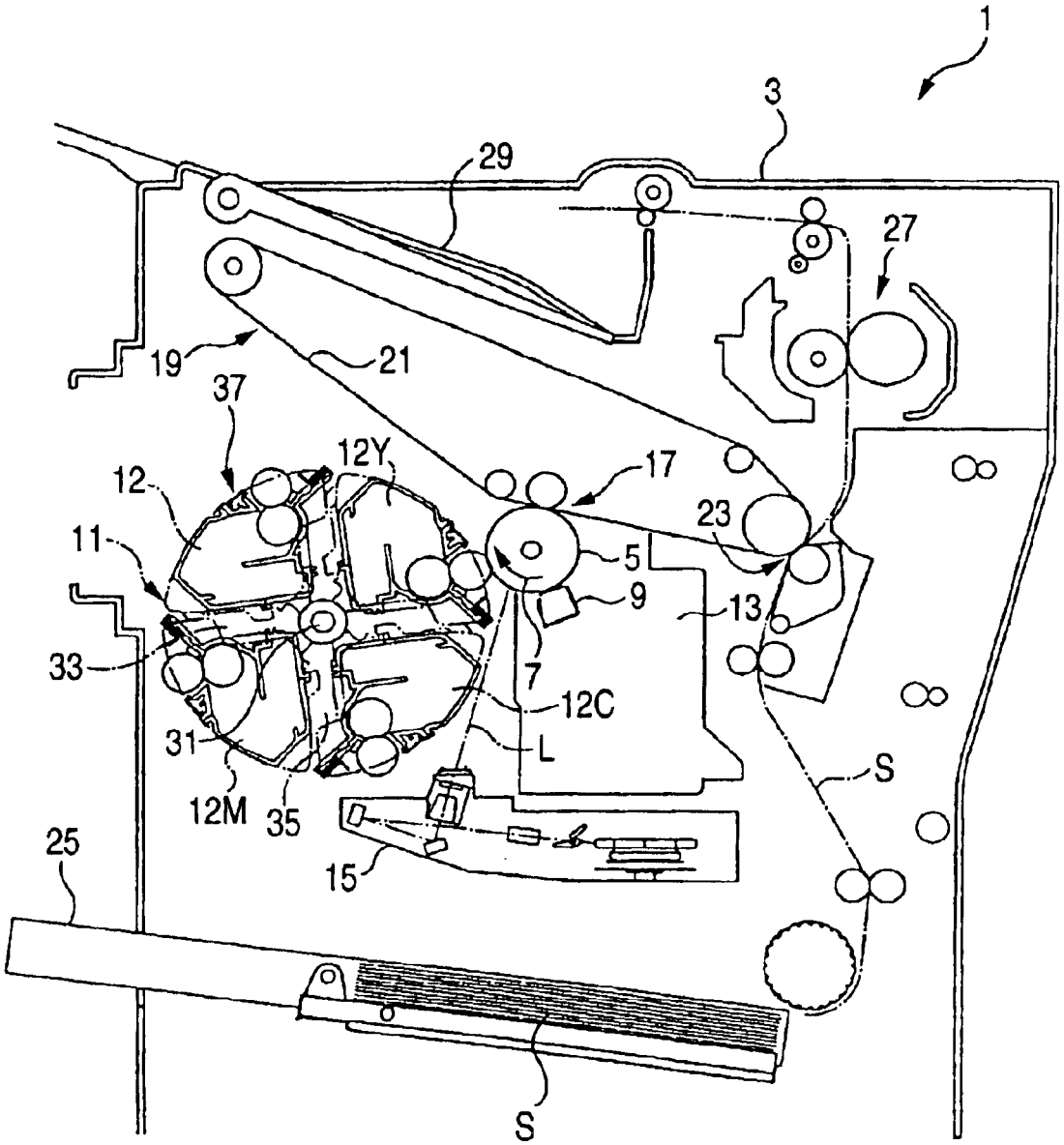
FIG. 9 is a sectional side view to show an image formation apparatus including developing devices having a roller support frame fixing apparatus according to a second embodiment of the invention.

Next, there is shown the second embodiment of the invention with FIGS. 9 to 18. FIG. 9 is a sectional side view to show an image formation apparatus 1 including developing devices having a roller support frame fixing apparatus. In the image formation apparatus 1, a photoconductor drum 5 is placed in an apparatus main unit 3 for rotation in the direction of an arrow 7. The photoconductor drum 5 is surrounded by a charger 9, a rotary developing unit 11 retaining developing devices, and a cleaning section 13 along the rotation direction 7 of the photoconductor drum 5. A charge bias is applied to the charger 9 from a charge bias circuit (not shown) and the peripheral surface of the photoconductor drum 5 can be charged uniformly.

A light exposure unit 15 is placed below the rotary developing unit 11 and laser light L is applied from the light exposure unit 15 toward the outer peripheral surface of the photoconductor drum 5 charged by the charger 9. The light exposure unit 15 scans the laser light L over the photoconductor drum 5 for exposure of the photoconductor drum 5 to light in response to image data provided by performing image expansion of an image formation command, thereby forming an electrostatic latent image corresponding to the image formation command on the photoconductor drum 5.

The electrostatic latent image thus formed is developed in toner by the rotary developing unit 11. That is, in the embodiment, the rotary developing unit 11 includes a yellow developing device 12Y, a cyan developing device 12C, a magenta developing device 12M, and a black developing device 12K, which are placed for rotation on a rotation shaft 31 of the rotary developing unit 11. As the position of the developing device 12Y, 12C, 12M, 12K in the circumferential direction of the rotary developing unit 11 is determined, the developing device 12Y, 12C, 12M, or 12K is selectively brought adjacent to the photoconductor drum 5 and can supply toner to the surface of the photoconductor drum 5. Accordingly, the electrostatic latent image on the photoconductor drum 5 is visualized in the selected toner color FIG. 9 shows a state in which the yellow developing device 12Y supplies the toner to the photoconductor drum 5. In the description that follows, "up (top)" and "down (bottom)" of the developing device are mentioned with the direction of the yellow developing device 12Y in FIG. 9 as the reference.

A transfer unit 19 is placed above the rotary developing unit 11 to the cleaning section 13. The transfer unit 19 includes an intermediate transfer belt 21 placed on a plurality of rollers and a drive section (not shown) for turning the intermediate transfer belt 21. The toner image provided by the rotary developing unit 11 is primary-transferred onto the intermediate transfer belt 21 of the transfer unit 19 in a primary transfer area 17. The toner remaining and deposited on the outer peripheral surface of the photoconductor drum 5 after the primary transfer is scraped off by the cleaning section 13 at the position where the photoconductor drum 5 rotates in the rotation direction indicated by the arrow 7 in FIG. 9 from the primary transfer area 17.

To transfer a color image to a sheet member S, color toner images formed on the photoconductor drum 5 are superposed on each other on the intermediate transfer belt 21 to form a color image, and the color image is secondary-transferred onto the sheet member S taken out from a cassette 25 in a secondary transfer area 23 The sheet member S with the color image thus formed thereon passes through a fixing unit 27 and is transported onto an ejection tray section 29 placed in an upper face portion of the apparatus main unit 3.

Figure 10:
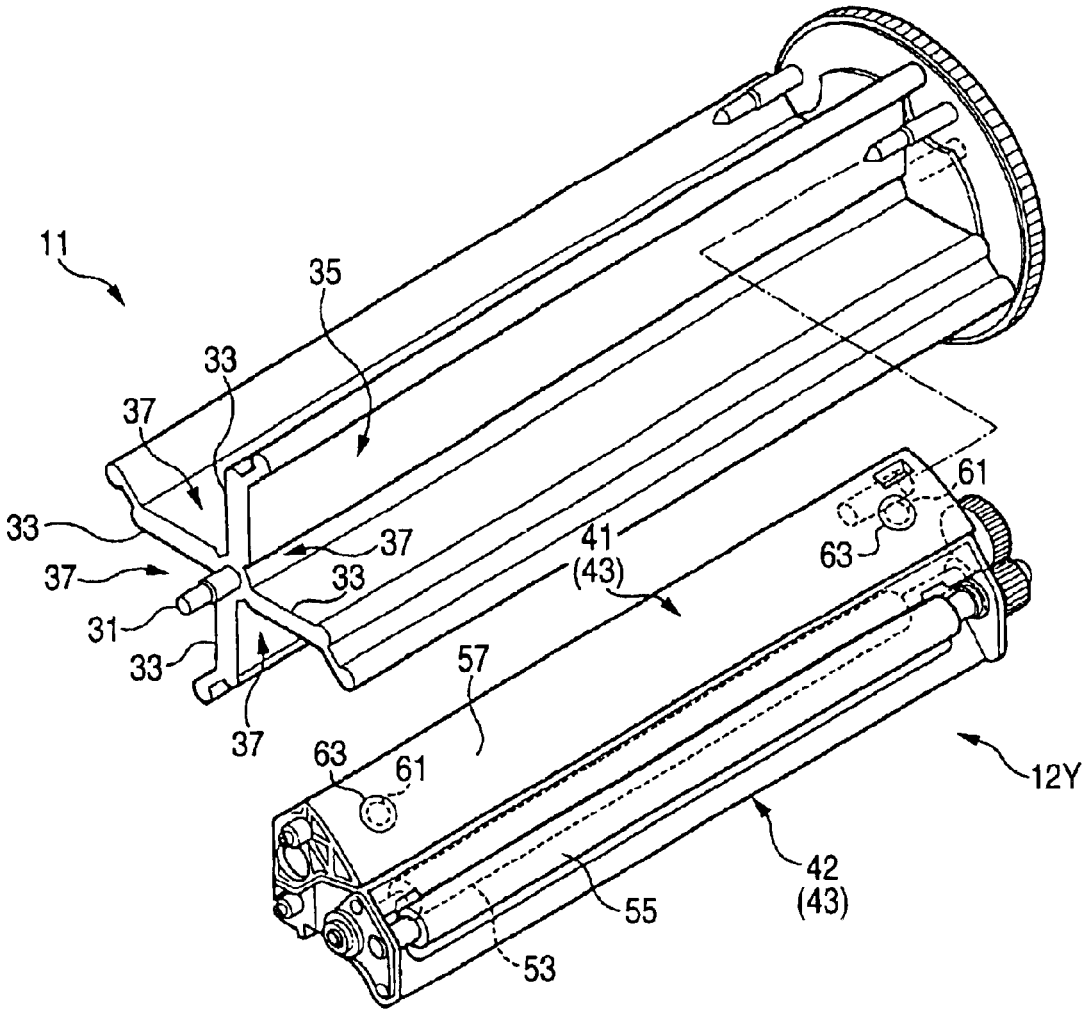
FIG. 10 is a perspective view of a rotary developing unit.

Next, the configuration and the operation of the rotary developing unit 11 included in the image formation apparatus 1 in FIG. 9 will be discussed. FIG. 10 is a perspective view of the rotary developing unit 11. As shown in FIG. 10, the rotary developing unit 11 has the rotation shaft 31 in the center and a support frame 35 made up of four frame elements 33 formed with spacing at angles of 90 degrees is fixed to the rotation shaft 31. A storage section 37 is defined between the frame elements 33, and the four color developing devices 12Y, 12C, 12M, and 12K are stored in the four storage sections 37 and are fixed to the support frame 35 by fixing fittings (not shown). FIG. 10 shows only the developing device 12Y for simplicity.

A drive section (not shown) is connected to the rotation shaft 31 through a clutch. The drive section can be driven for rotating the support frame 35, thereby positioning any one of the four developing devices 12Y, 12C, 12M, and 12K selectively at a developing position (in FIG. 9, the position of the developing device 12Y) opposed to the photoconductor drum 5.

The developing devices 12Y, 12C, 12M, and 12K retained on the support frame 35 have the same configurations. Therefore, in the description that follows, the developing devices 12Y, 12C, 12M, and 12K are collectively called the developing device 12.

Figure 11:
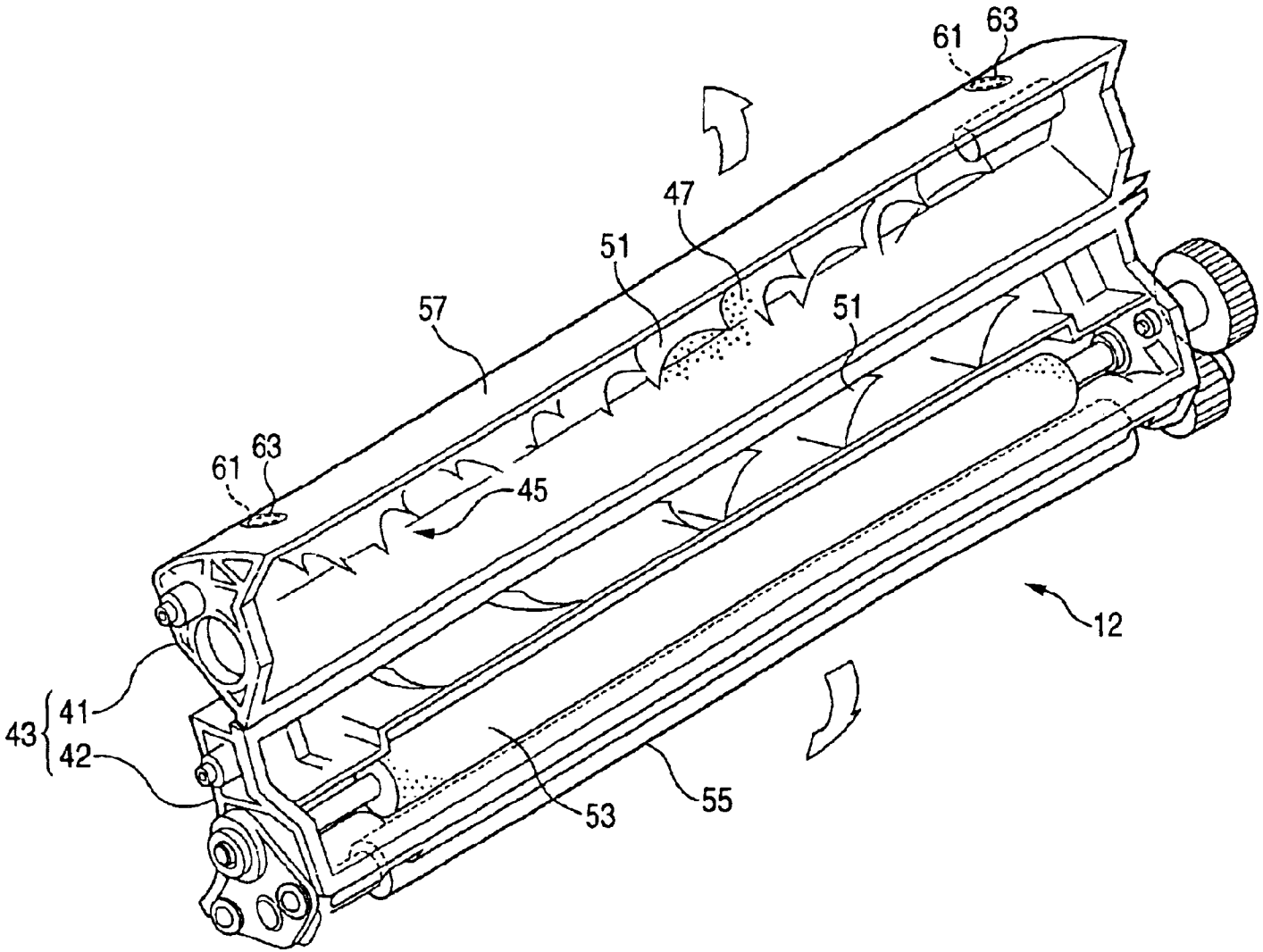
FIG. 11 is a perspective view to show a developing device in a state in which an upper housing member and a lower housing member are opened in arrow directions according to the invention.

The developing device 12 is formed with a housing 43 as a main body into which an upper housing member 41 and a lower housing member 42 are combined integrally. FIG. 11 shows a state in which the upper housing member 41 and the lower housing member 42 are opened in arrow directions.

A toner storage section 45 for storing toner is formed in the housing 43 and is formed with a plurality of inclined agitation pieces 51 for agitating toner 47. When the rotary developing unit 11 rotates on the rotation shaft 31, the toner 47 drops along the agitation pieces 51, so that the toner 47 is agitated in the toner storage section 45.

Figure 12:
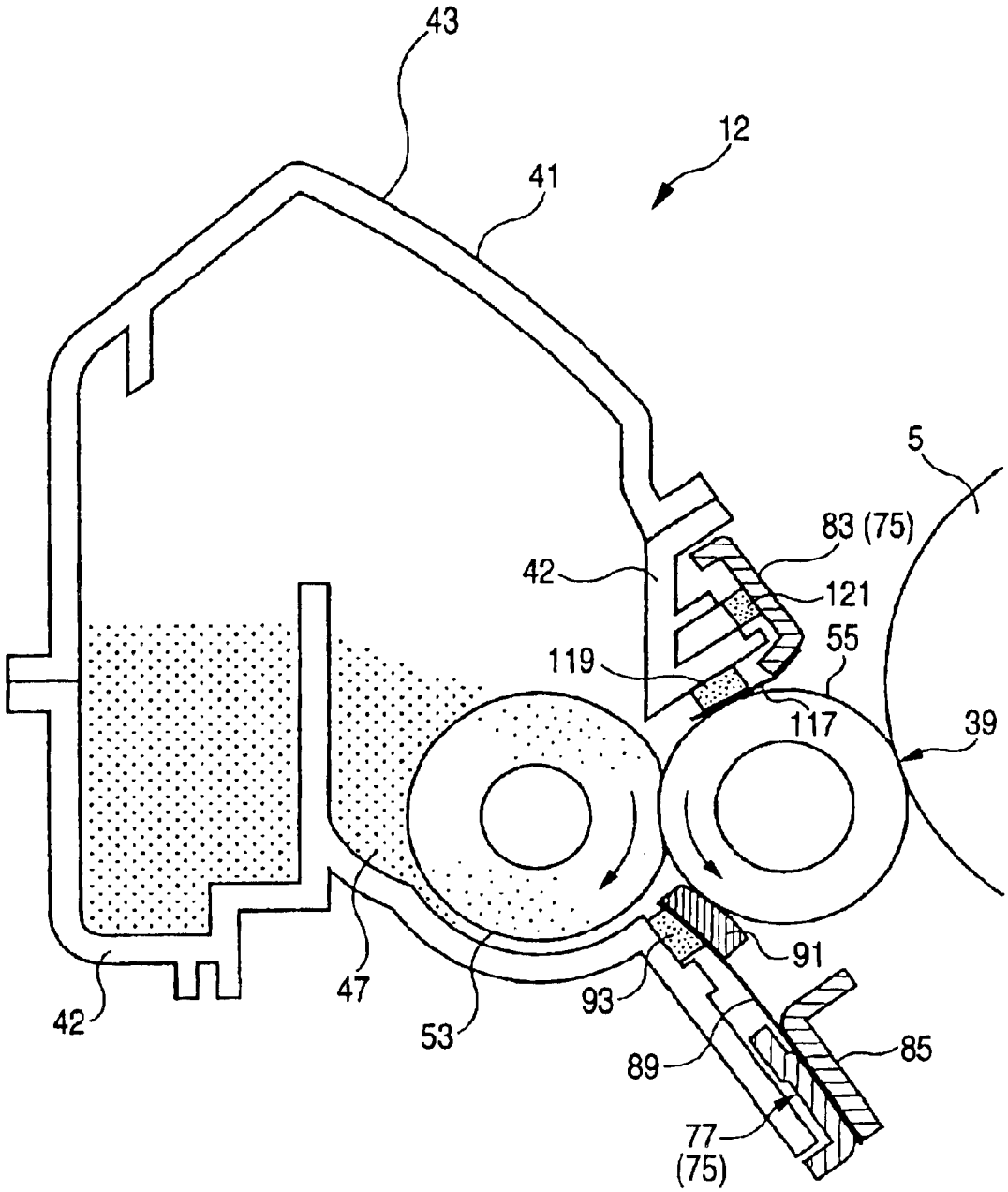
FIG. 12 is a sectional side view of the developing device according to the invention.

A supply roller 53 (also called S roller) having a surface formed of a urethane sponge is placed rotatably in the toner storage section 45. As shown in FIGS. 11 and 12, a developing roller 55 (also called D roller) is placed on the outer side of the supply roller 53 in a contact state with the supply roller 53. When the supply roller 53 rotates in the arrow direction in a state in which the toner 47 stored in the housing 43 is supported on the surface of the supply roller 53, the developing roller 55 rotates in the arrow direction in FIG. 12 at the same speed as the supply roller 53 while receiving the toner 47 on the outer peripheral surface of the developing roller 55 from the supply roller 53.

The developing roller 55 rotates while coming in contact with the photoconductor drum 5, and the toner 47 supported on the developing roller 55 is deposited on the surface of the photoconductor drum 5 at a developing position 39. Thus, the toner 47 is rubbed against the surface of the developing roller 55 from the supply roller 53 and forms a toner layer of a predetermined thickness (for example, several 100 $\mu$m) and the toner layer is moved to the photoconductor drum 5 in a similar manner.

Figure 13A:
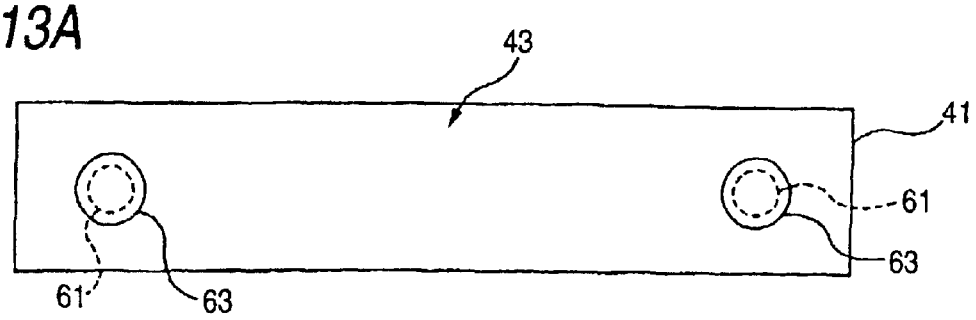
FIGS. 13A to 13D are front views to show four embodiments of communication holes formed in a housing according to the invention.

As shown in FIGS. 10 and 13A, communication holes 61 for allowing air in the toner storage section 45 to communicate with the atmosphere are formed in an upper face 57 of the upper housing member 41 forming a part of the housing 43. A seal 63 formed with a large number of minute holes each of a size for allowing air to pass through and blocking toner is put on each communication hole 61. The air communication member with the inside of the toner storage section 45 is provided in the upper face 57 of the upper housing member 41, whereby when the rotary developing unit 11 rotates on the rotation shaft 31, as the toner 47 drops, the lower air is pushed out through the communication holes 61, so that air in the toner storage section 45 can be changed.

Figure 14A:
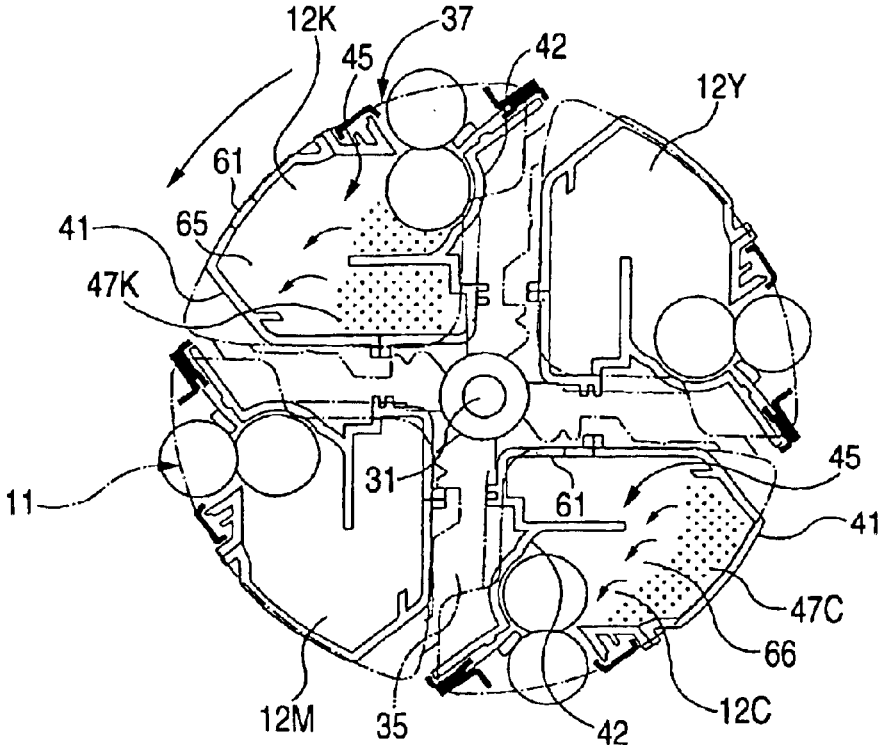
FIGS. 14A and 14B are schematic drawings to show motion of toner in each developing device when the rotary developing unit rotates from a state shown in FIG. 14A to a state shown in FIG. 14B with attention focused on developing devices 12C and 12K according to the invention.
Figure 14B:
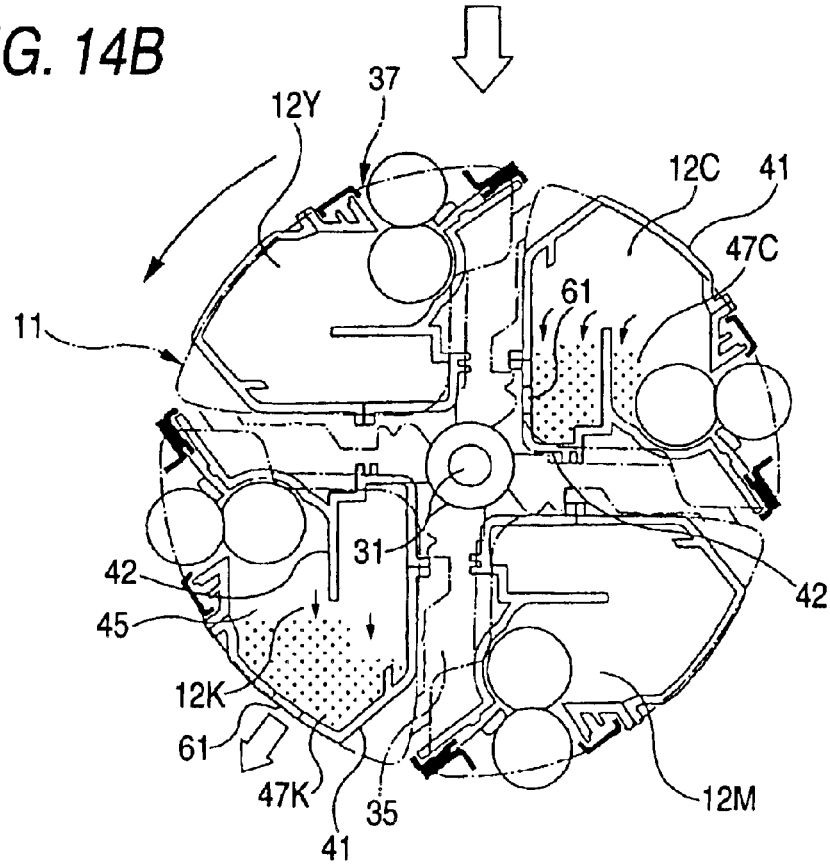

FIGS. 14A and 14B show motion of the toner 47 in each of the developing devices 12C a and 12K when the rotary developing unit 11 rotates from a state shown in FIG. 14A to a state shown in FIG. 14B with attention focused on the developing device 12C and 12K. The seals 63 are not shown in FIG. 14A or 14B.

In FIG. 14A, toner 47K in the developing device 12K is placed in the lower housing member 42. Then, when the rotary developing unit 11 rotates to the position shown in FIG. 14B, toner 47K in the developing device 12K moves so as to drop to the upper housing member 41. At the time, air in a space 65 in the toner storage section 45 is expelled from the communication holes 61 by the toner 47K dropping so as to cover from the top.

The communication hole 61 with the seal 63 put thereon may be formed in the lower housing member 42. The communication hole 61 thus formed in the lower housing member 42 is shown in the developing device 12C. The communication hole 61 may be formed in each of the upper housing member 41 and the lower housing member 42 of one developing device.

If the communication hole 61 is formed in the lower housing member 42, when the rotary developing unit 11 rotates from the state in which the toner 47C in the developing device 12C is placed in the upper housing member 41 to the position shown in FIG. 14B, the toner 47C in the developing device 12C moves so as to drop to the lower housing member 42. At the time, air in a space 66 in the toner storage section 45 is expelled from the communication hole 61 formed in the lower housing member 42 by the toner 47C dropping so as to cover from the top.

Air in the toner storage section 45 can be thus circulated freely through the communication hole 61, whereby there is not a negative pressure in the toner storage section 45 and the pressure in the toner storage section 45 can always be made equal to the atmospheric pressure in the process in which the toner 47 in the toner storage section 45 is consumed. If a heat generation source exists in the proximity of the toner storage section 45, heat from the heat generation source can be prevented from causing air in the toner storage section 45 to be expanded and entering a pressurization state. Therefore, the effect of the pressure in the toner storage section 45 can be excluded so that the toner supply state from the toner storage section 45 can always be maintained constant.

The communication hole 61 with the seal 63 put thereon needs to be made at such a position allowing air in the housing to be pushed out or sucked, namely, "breathing" by motion of the toner 47 with rotation of the rotary developing unit 11.

The communication hole 61 may be made at any position of the upper housing member 41 or the lower housing member 42 where the function as described above can be provided; however, preferably the communication holes 61 are formed in the vicinities of both ends of the upper housing member 41 or the lower housing member 42. The reason will be discussed with reference to FIG. 15.

Figure 15:
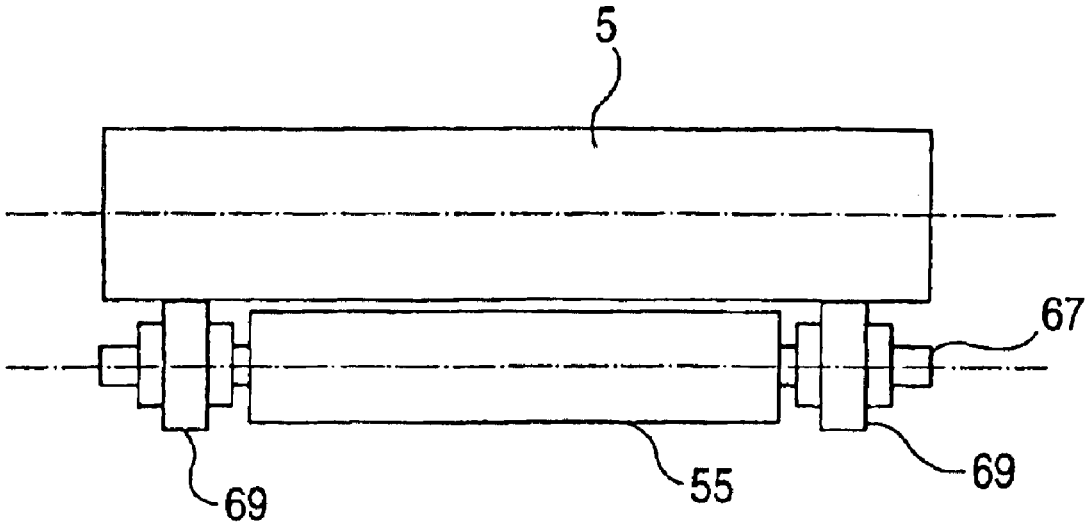
FIG. 15 is a side view to show a state in which abutment regulation rollers placed on a developing roller of the developing device collide with the photoconductor drum according to the invention.

As shown in FIG. 15, the developing roller 55 is attached to a rotation shaft 67, and abutment regulation rollers 69 each having a slightly larger diameter than the developing roller 55 are placed rotatably at both ends of the rotation shaft 67. In FIG. 9, as the rotary developing unit 11 rotates and the yellow developing device 12Y, for example, approaches the photoconductor drum 5, the peripheral surfaces of the two abutment regulation rollers 69 of the developing device 12Y collide lightly with the photoconductor drum 5 for defining the distance between the peripheral surface of the developing roller 55 and that of the photoconductor drum 5 as a predetermined distance. The predetermined distance is drawn comparatively large in FIG. 15; in fact, however, it is an extremely small distance of 1 mm or less.

Vibration occurring when the peripheral surfaces of the two abutment regulation rollers 69 collide with the photoconductor drum 5 propagates particularly easily to the vicinities of both ends of the housing 43 in the proximity of the collision and therefore the toner 47 in the vicinities of both ends of the housing 43 easily drops in a stroke due to the vibration. For this reason, preferably the communication holes 61 are formed in the vicinities of both ends of the upper housing member 41 or the lower housing member 42, particularly at the positions corresponding to the positions of the two abutment regulation rollers 69.

Figure 13B:
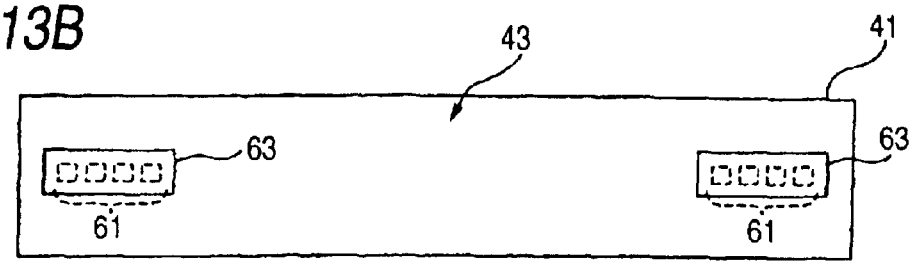
Figure 13C:
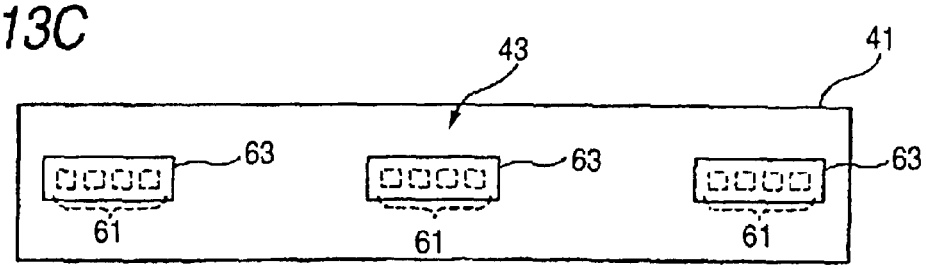

As the communication holes 61, a comparatively large hole may be made at each of both ends of the housing 43 as shown in FIG. 13A; a group of four (or any number of) small holes may be made at each of both ends of the housing 43 in place of large holes as shown in FIG. 13B; or a plurality of small holes may also be made at the center of the housing 43 in addition to the communication holes 61 at both ends as shown in FIG. 13C. The seal 63 having minute holes is put on every group of small holes, as described above.

Figure 13D:
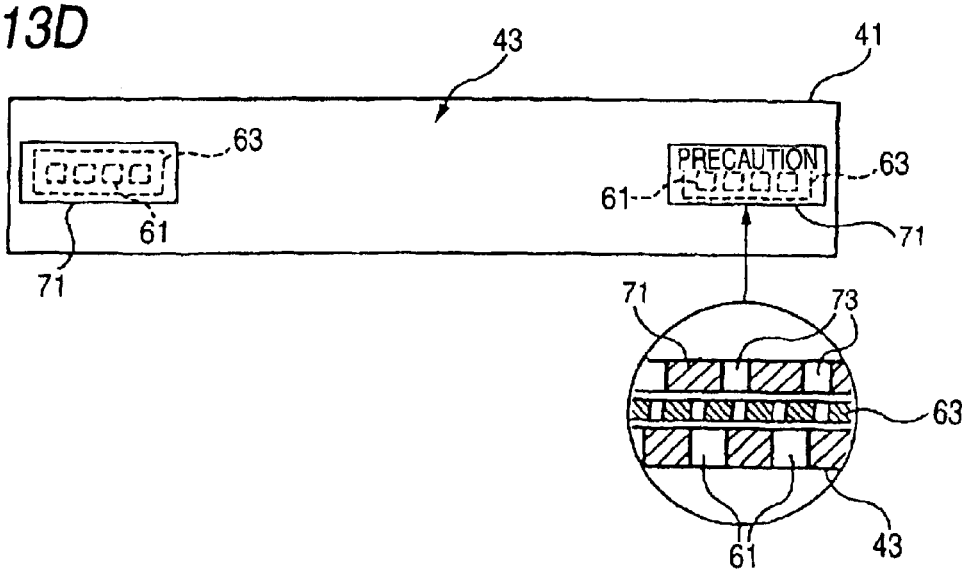

A label 71 describing a handling precaution, etc., for example, may be put on the seal 63 having minute holes put on the communication hole 61, as shown in FIG. 13D. The label 71 is formed with air holes 73 for allowing air to communicate as shown in a sectional view enlarged in FIG. 13D, whereby an air communication function through the communication hole 61 can be provided.

Figure 16A:
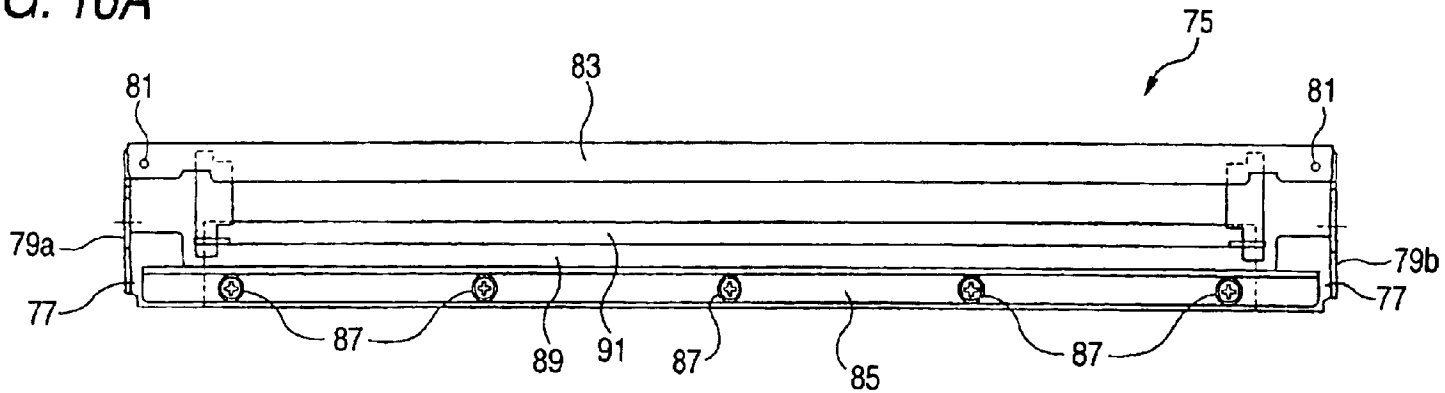
FIG. 16A is a front view to show the whole of a roller support frame according to the invention.
Figure 16B:
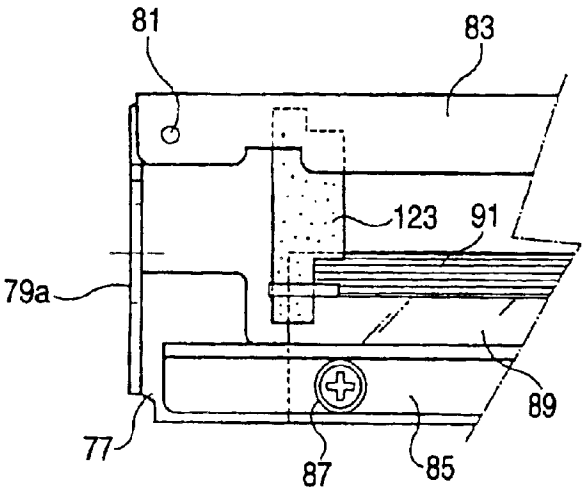
FIG. 16B is an enlarged view of the left portion of the roller support frame according to the invention.

Next, the peripheral structure of the developing roller 55 in the developing device 12 will be discussed. A roller support frame 75 is fixed to the housing 43 of the developing device 12. The roller support frame 75 is formed entirely of metal and is made up of a lower frame portion 77, side frame portions 79*a* and 79*b* bended at 90 degrees from both ends of the lower frame portion 77, and an upper frame portion 83 connected to the top ends of the side frame portions 79*a* and 79*b* by screws 81, as shown in FIG. 16A. The developing roller 55 can be placed in the space surrounded by the lower frame portion 77, the upper frame portion 83, and the two side frame portions 79*a* and 79*b*.

A blade fixing frame 85 is attached to the lower frame portion 77 by a plurality of fixing screws 87. A blade support plate 89 made of phosphor bronze is placed between the blade fixing frame 85 and the lower frame portion 77 as shown in FIG. 12. A regulation blade 91 formed of a rubber member, a resin member, etc., is put on the top face of the tip of the blade support plate 89. The regulation blade 91 is pressed against the peripheral surface of the developing roller 55 in the length direction of the developing roller 55 at constant pressure by the spring return action of the blade support plate 89 itself and the flexible return action of a backup sponge 93 (see FIG. 12) placed on the lower side of the tip of the blade support plate 89.

The regulation blade 91 has a function such that as the toner 47 rubs with the regulation blade 91, it is charged to the same polarity. Thus, the toner charged to a predetermined polarity is supplied to the developing roller 55 and the electrostatic latent image on the photoconductor drum 5 can be developed in the toner 47 on the developing roller 55.

The regulation blade 91 also has a function of evening the toner 47 deposited on the peripheral surface of the developing roller 55 so that the thickness of the toner finally becomes about 100 $\mu$m, for example. Therefore, to make uniform the thickness of the toner 47 in the length direction of the developing roller 55, for the developing device 12, it is important to press the regulation blade 91 against the peripheral surface of the developing roller 55 in the length direction of the developing roller 55 at constant pressure.

To ensure evening of the press pressure of the regulation blade 91 against the developing roller 55, as described above, the upper frame portion 83 is added as a component of the roller support frame 75 to form the roller support frame 75 as a closed loop structure.

That is, such a closed loop structure is adopted and the developing roller 55 and the regulation blade 91 are put into a unit, whereby the shape retention of the roller support frame 75 is enhanced. Thus, when the developing device 12 is placed in or removed from the storage section 37 of the rotary developing unit 11, if a considerable force is applied to the roller support frame 75, the positional relationship between the peripheral surface of the developing roller 55 and the regulation blade 91 becomes hard to change in the length direction. Accordingly, the regulation blade 91 always continues to press the peripheral surface of the developing roller 55 by a constant force in the length direction of the regulation blade 91, so that the distribution of the toner 47 on the peripheral surface of the developing roller 55 can be prevented from being one-sided in the length direction of the developing roller 55 and a print failure of inconsistencies in color density, etc., can be prevented.

Next, a structure of attaching the roller support frame 75 to the lower housing member 42 will be discussed with reference to FIGS. 17A and 17B. FIG. 17A shows how a shaft 103 is supported as the left of the developing roller 55 in FIG. 11 is broken away and FIG. 17B shows how the shaft is supported as the right of the developing roller 55 in FIG. 11 is broken away.

Figure 17B:
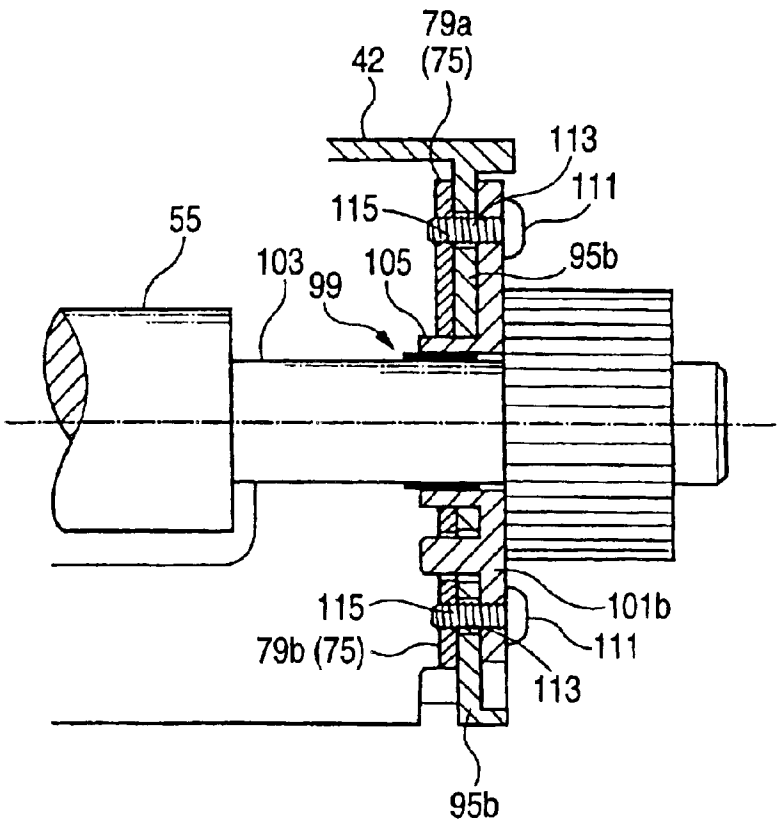
FIG. 17A is a sectional view to show how a shaft is supported as the left of the developing roller in FIG. 11 is broken away according to the invention and FIG. 17B is a sectional view to show how the shaft is supported as the right of the developing roller in FIG. 11 is broken away according to the invention.
Figure 17A:
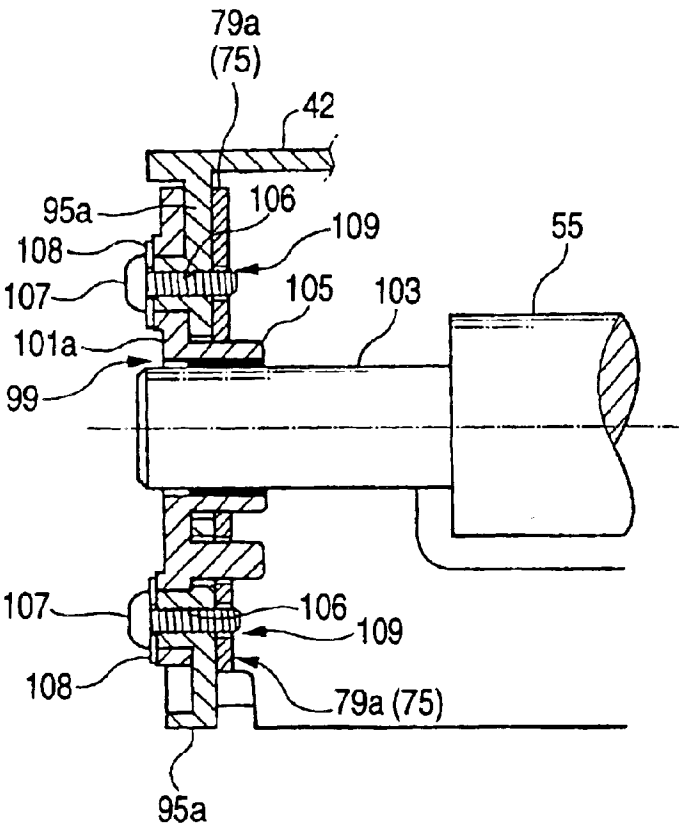

As shown in FIGS. 17A and 17B, supply roller through holes (not shown) and developing roller through holes 99 are formed in end faces 95*a* and 95*b* of the lower housing member 42. Also, shaft retention members 101*a* and 101*b* are placed on the outer sides of the end faces 95*a* and 95*b*. Although not shown, the shaft of the supply roller 53 is rotatably supported at both end parts on shaft retention parts (not shown) extended into the supply roller through holes from the shaft retention members 101*a* and 101*b*.

The shaft 103 of the developing roller 55 is rotatably supported at both end parts on shaft retention parts 105 extended into the developing roller through holes 99 from the shaft retention members 101*a* and 101*b*. As shown in FIG. 17A, two holes 106 each slightly smaller than the thread of a first screw 107 is formed in the left end face 95*a* of the lower housing member 42 and the first screw 107 is forcibly screwed in each hole 106 through a washer 108, whereby the left shaft retention member 101*a* and the left end face 95*a* of the lower housing member 42 are fixed. The left side frame portion 79*a* in the roller support frame 75 is also formed with two holes for the first screws 107 at the positions aligned with the holes 106 in the left end face 95*a* of the lower housing member 42. The holes for the first screws 107 are unloaded holes 109 each a little larger than the thread of the first screw 107 and the first screws 107 are not screwed into the unloaded holes 109 and are simply inserted therein.

On the other hand, as shown in FIG. 17B, two unloaded holes 113 each larger than the thread of a second screw 111 are formed in the right end face 95*b* of the lower housing member 42, and the right side frame portion 79*b* in the roller support frame 75 is formed with two screw holes 115 formed with female screws for the second screws 111 at the positions aligned with the unloaded holes 113. The second screws 111 are screwed in the unloaded holes 113 and the screw holes 115 via holes formed in the right shaft retention member 101*b* in such a manner that the end face 95*b* of the housing is sandwiched between the right side frame portion 79*b* and the right shaft retention member 101*b*, whereby the right shaft retention member 101*b*, the right end face 95*b* of the lower housing member 42, and the right side frame portion 79*b* are fixed in one piece.

Consequently, the relationship between the housing 43 and the roller support frame 75 is as follows: On the right side, they are fixed integrally to each other so that moving of the housing 43 and the roller support frame 75 in the length direction of the housing is regulated; on the left side, the side frame portion 79*a* of the roller support frame 75 is not fixed to the end face 95*a* of the lower housing member 42 and thus the insertion portion of the first screw 107 in the unloaded hole 109 is guided and it is made possible for the housing 43 and the roller support frame 75 to freely move relatively in the length direction of the housing without affecting each other.

The reason why the structure is adopted is that the resin of which the housing 43 is formed has a larger thermal expansion coefficient than the metal of which the roller support frame 75 is formed and therefore expansion difference is produced between the housing 43 and the roller support frame 75 (the housing 43 has a larger expansion amount) due to temperature change and the effect of the expansion difference is to be eliminated. That is, the structure makes it possible to prevent distortion of the roller support frame 75 caused by the expansion difference between the housing 43 and the roller support frame 75, so that the abutment pressure of the regulation blade 91 against the outer peripheral surface of the developing roller 55 placed in the roller support frame 75 can be maintained continuously constant in the length direction of the regulation blade 91 and it is made possible to supply toner evenly in the length direction.

Although not clearly shown in FIGS. 17A, 17B, as gap between the end face 95*a* of the lower housing member 42 and the side frame portion 79*a* of the roller support frame 75, a slight gap is formed therebetween even in a state in which the lower housing member 42 is most contracted in an assumed usual operating environment.

Next, a structure for preventing the toner 47 from scattering to the outside from the toner storage section 45 in the housing 43 will be discussed. As shown in FIG. 12, a scatter prevention seal member 117 is fixed to the upper frame portion 83 of the roller support frame 75 above the developing roller 55, and is pressed at an opposite end against the developing roller 55 by a backup sponge 119 fixed to the lower housing member 42, thereby preventing the toner 47 from scattering to the outside from space between the developing roller 55 and the upper frame portion 83.

A seal member 121 is put on the inside of the upper frame portion 83 of the roller support frame 75 for blocking the gap between the upper frame portion 83 and the lower housing member 42, thereby preventing the toner 47 passing through the backup sponge 119 from scattering to the outside.

Figure 16C:
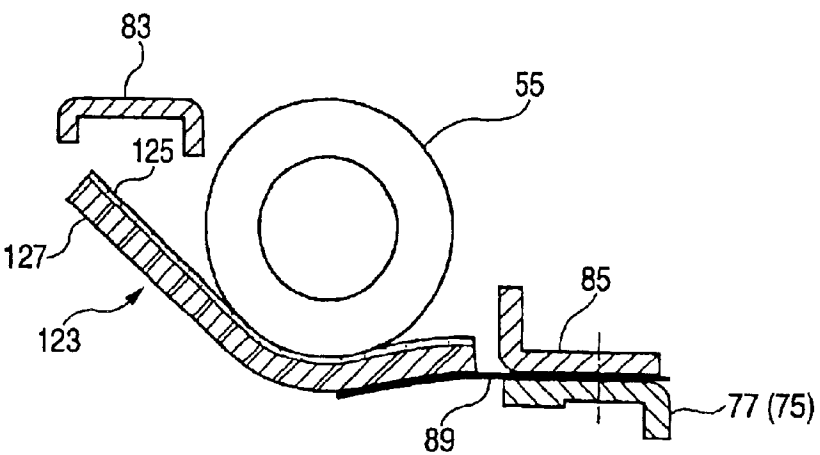
FIG. 16C is a sectional side view to show roller end seal member and roller support frame peripheries according to the invention.
Figure 18:
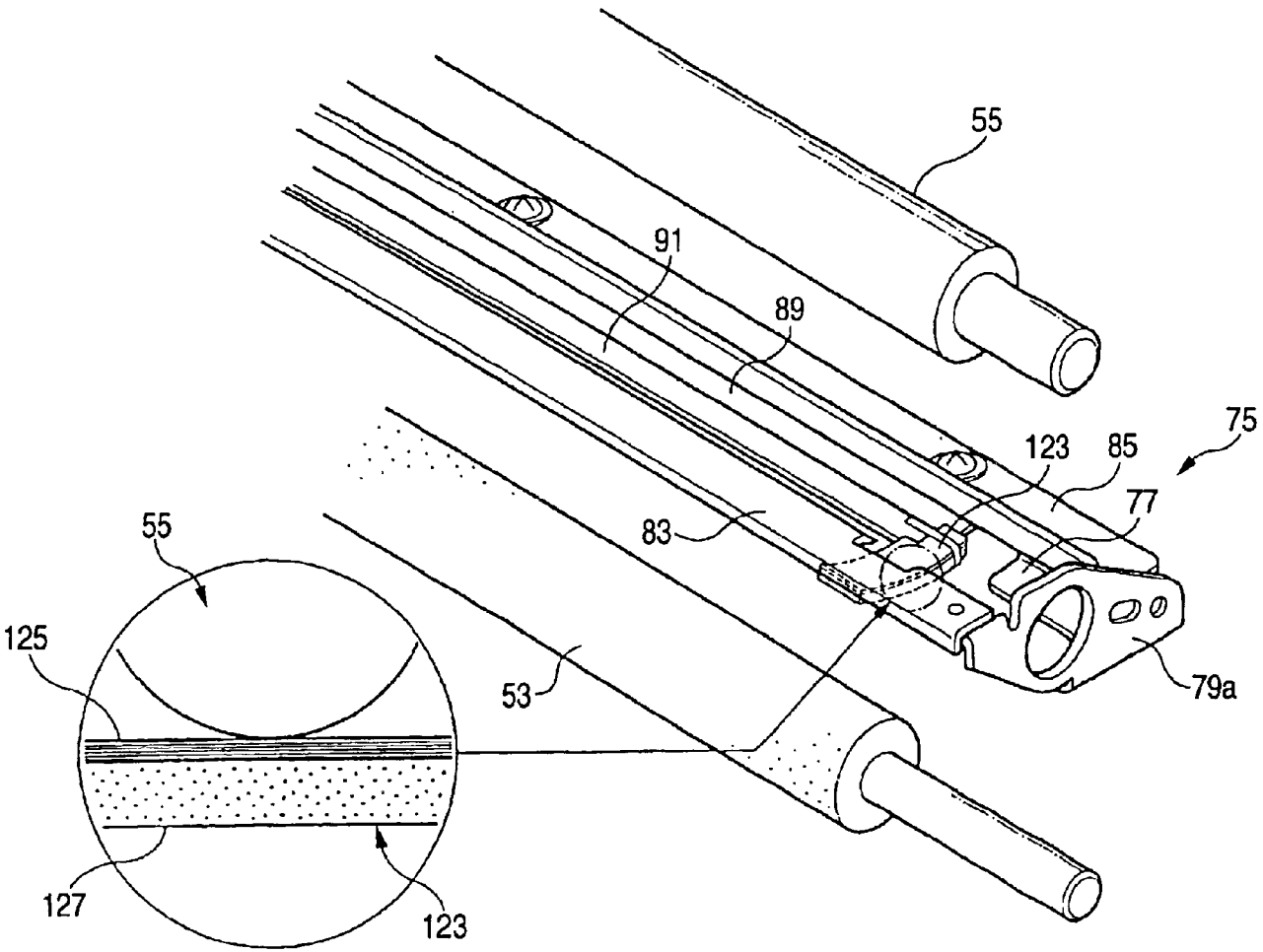
FIG. 18 is a perspective view to show the roller support frame and a supply roller and the developing roller supported in the roller support frame.

Further, as shown in FIGS. 16C and 18, roller end seal members 123 abut both end parts of the peripheral surface of the developing roller 55 for preventing the toner 47 from scattering to the outside from the end parts of the developing roller 55. As shown in a partially enlarged side view in FIG. 18, the roller end seal member 123 is of a double structure having an upper low-friction function member 125 and a lower powder seal function member 127 stuck on each other. The upper low-friction function member 125 is formed of a material having excellent durability to rotation abrasion for lessening rotation friction resistance on the contact face with the developing roller 55 as much as possible, such as FUJIRON 3000 (registered trademark) (manufactured by Fujiko Kabushiki kaisha). The lower powder seal function member 127 is formed of a material having an excellent seal function of powder of toner, etc., such as wool felt.

The roller end seal member 123 is fixed on the base end side to the blade support plate 89 or the lower frame portion 77 and is supported at the tip from below by the lower housing member 42, but the tip is not fixed to the lower housing member 42 and forms a free end.

The tip of the roller end seal member 123 is made a free end, whereby the contact state between the peripheral surface at both ends of the developing roller 55 and the roller end seal member 123 varies finely with time, so that the problem of degrading the seal performance as only the same place of the roller end seal member 123 becomes worn like a groove can be circumvented.

Although the developing devices, etc., according to the invention have been described based on the first and second embodiments, it is to be understood that the embodiments of the invention are intended for easy understanding of the invention and the invention is not limited to the embodiments. It is further to be understood that various changes and modifications may be made in the invention without departing from the spirit and scope thereof and that equivalences are contained in the invention, of course.

The invention is effective particularly for the described developing device wherein the tip of the regulation blade is not in contact with the toner supporter, the part at a predetermined distance from the tip is in contact with the toner supporter, and the contact position is below the rotation center position of the toner supporter. However, the invention can also be applied to a developing device with the tip of the regulation blade being in contact with the toner supporter or a developing device with the contact position being above the rotation center position of the toner supporter.

The invention is effective particularly for the developing device having the rotatable toner supply member for supplying toner to the toner supporter wherein the rotation direction of the toner supply member is opposite to the rotation direction of the toner supporter. However, the invention can also be applied to a developing device wherein the rotation direction of the toner supply member is the same as the rotation direction of the toner supporter.

The invention is effective particularly for the developing device having the seal member abutting the toner supporter to prevent toner leakage in the developing device wherein the abutment position is above the rotation center position of the toner supporter. However, the invention can also be applied to a developing device wherein the abutment position is below the rotation center position of the toner supporter.

The invention is effective particularly for the developing device having the toner storage section for storing toner wherein the toner supply member is placed below the toner storage section and toner stored in the toner storage section is supplied to the toner supporter by the toner supply member in a lower part of the toner storage section. However, the invention can also be applied to a developing device wherein the toner supply member is placed above the toner storage section and toner stored in the toner storage section is supplied to the toner supporter by the toner supply member in an upper part of the toner storage section.

Further, in the described embodiments, the image formation apparatus has been described by taking the full-color laser beam printer of intermediate transfer type as an example. However, the invention can be applied to various image formation apparatus such as a full-color laser beam printer of any type other than the intermediate transfer type, a monochrome laser beam printer, a copier, and a facsimile.

The photoconductor is not limited to the photoconductive roller having a photoconductive layer on the outer peripheral surface of a conductive base material shaped like a cylinder, and may be a photoconductive belt having a photoconductive layer on the surface of a conductive base material shaped like a belt.

The developing device according to the invention is not limited to the unit of the configuration described in the embodiment. The invention can be applied to any developing device if the developing device has at least a toner supporter for supporting toner and moving and a thickness regulation member for regulating the thickness of the toner supported on the toner supporter. The toner supporter and toner supply member are not limited to rollers and may be of other shapes such as a belt.

For example, as the toner supporter, any of magnetic substance, nonmagnetic substance, conductive substance, insulating substance, metal, rubber, resin, etc., can be used if the material can form the toner supporter. For example, metal such as aluminum, nickel, stainless steel, or iron, rubber such as natural rubber, silicone rubber, urethane rubber, butadiene rubber, chloroprene rubber, neoprene rubber, or NBR, or resin such as styrol resin, vinyl chloride resin, polyurethane resin, polyethylene resin, methacrylic resin, or nylon resin can be used as the material. The upper layer of the material can also be coated for use, needless to say. To do this, as the coat material, polyethylene, polystyrene, polyurethane, polyester, nylon, acryl, etc., can be used. As the form, any of a non-elastic body, an elastic body, a single layer, multilayer, a film, a roller, etc., can be used.

Likewise, as the toner supply member, in addition to polyurethane foam described above, polystyrene foam, polyethylene foam, polyester foam, ethylene propylene foam, nylon foam, silicone foam, etc., can be used as material. As the foam cell of the toner supply member, either single foam or continuous foam can be used. Not only foam material, but also a rubber material having elasticity may be used. In particular, a material having a conductive material of carbon, etc., dispersed and molded in silicone rubber, urethane rubber, natural rubber, isoprene rubber, styrene-butadiene rubber, butadiene rubber, chloroprene rubber, butyl rubber, ethylene propylene rubber, epichlorohydrin rubber, nitrile-butadiene rubber, or acrylic rubber can be used.

As the thickness regulation member, the member having the rubber part and the rubber support part is used as described above. As the material of the rubber part, in addition to silicone rubber or urethane rubber described above, natural rubber, isoprene rubber, styrene-butadiene rubber, butadiene rubber, chloroprene rubber, butyl rubber, ethylene propylene rubber, epichlorohydrin rubber, nitrile-butadiene rubber, or acrylic rubber etc., can be used. The thickness regulation member need not be formed by joining the rubber part and the rubber support part manufactured separately; for example, any of the materials can also be molded solely in one piece to form the thickness regulation member or the thickness regulation member can also be formed of a stainless thin plate solely. The upper layer of the material can also be coated with resin for use. As the coat material, polyethylene, polystyrene, nylon, polyurethane, polyester, etc., can be used.

[Configuration of Computer System, etc.,]

Next, a computer system, a computer program, and a record medium recording the computer program according to the third embodiment of the invention will be discussed with reference to FIGS. 6 and 7.

Figure 6:
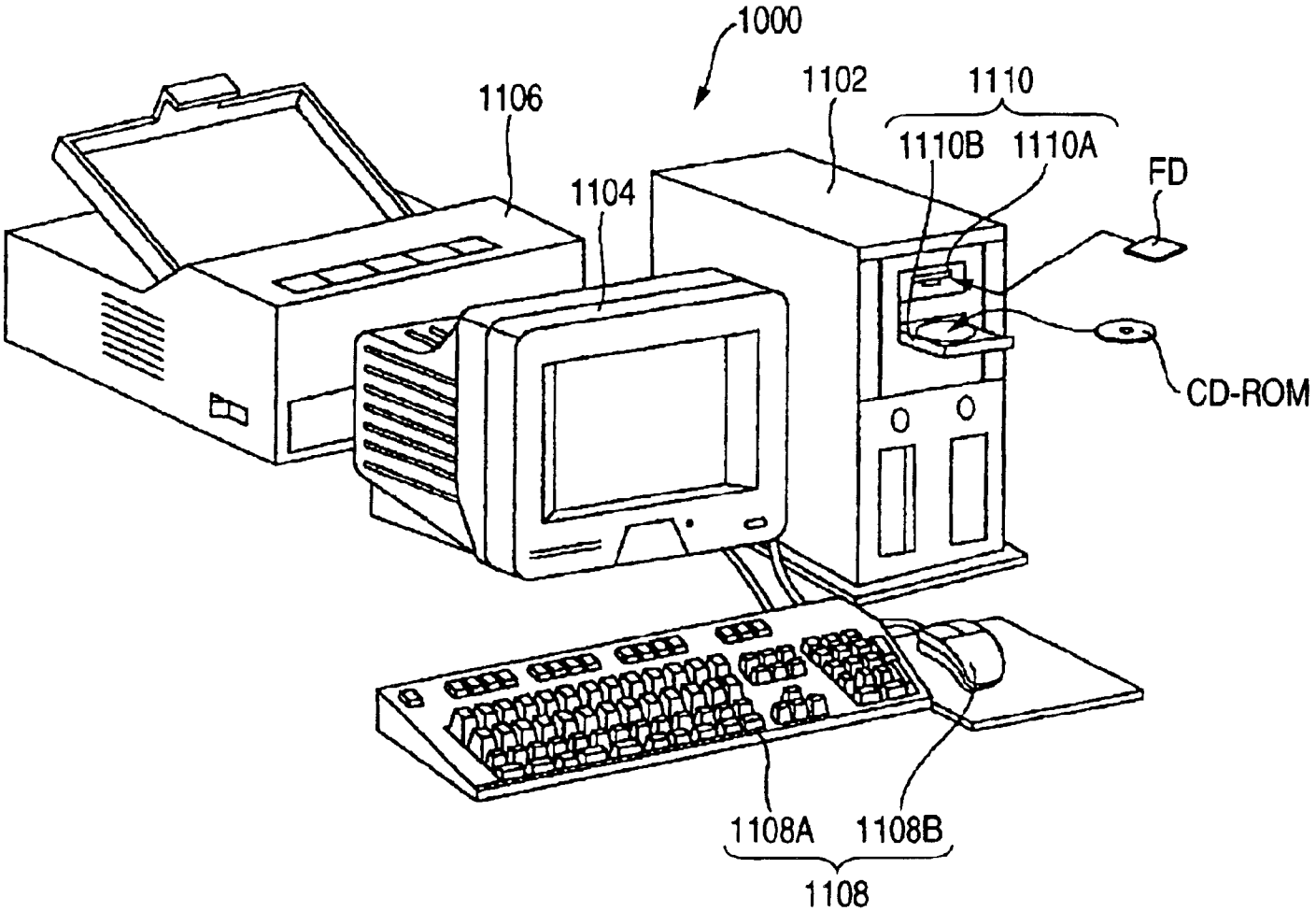
FIG. 6 is a schematic representation to show the appearance configuration of a computer system.

FIG. 6 is a schematic representation to show the appearance configuration of a computer system. A computer system 1000 includes a computer main unit 1102, a display 1104, a printer 1106, an input unit 1108, and a read unit 1110. The computer main unit 1102 is housed in a minitower cabinet in the embodiment, but need not necessarily be housed in a minitower cabinet. As the display 1104, generally a CRT (Cathode Ray Tube), a plasma display, a liquid crystal display, or the like is used, but the display is not limited to them. As the printer 1106, the printer described in the first and the second embodiments is used. As the input unit 1108, a keyboard 1108A and a mouse 1108B are used in the embodiment, but the input unit is not limited to them. As the read unit 1110, a flexible disk drive unit 1110A and a CD-ROM drive unit 1110B are used in the embodiment, but the read unit is not limited to them; any other machine, such as an MO (Magneto Optical) disk drive unit or a DVD (Digital Versatile Disk) drive unit, may be used.

Figure 7:
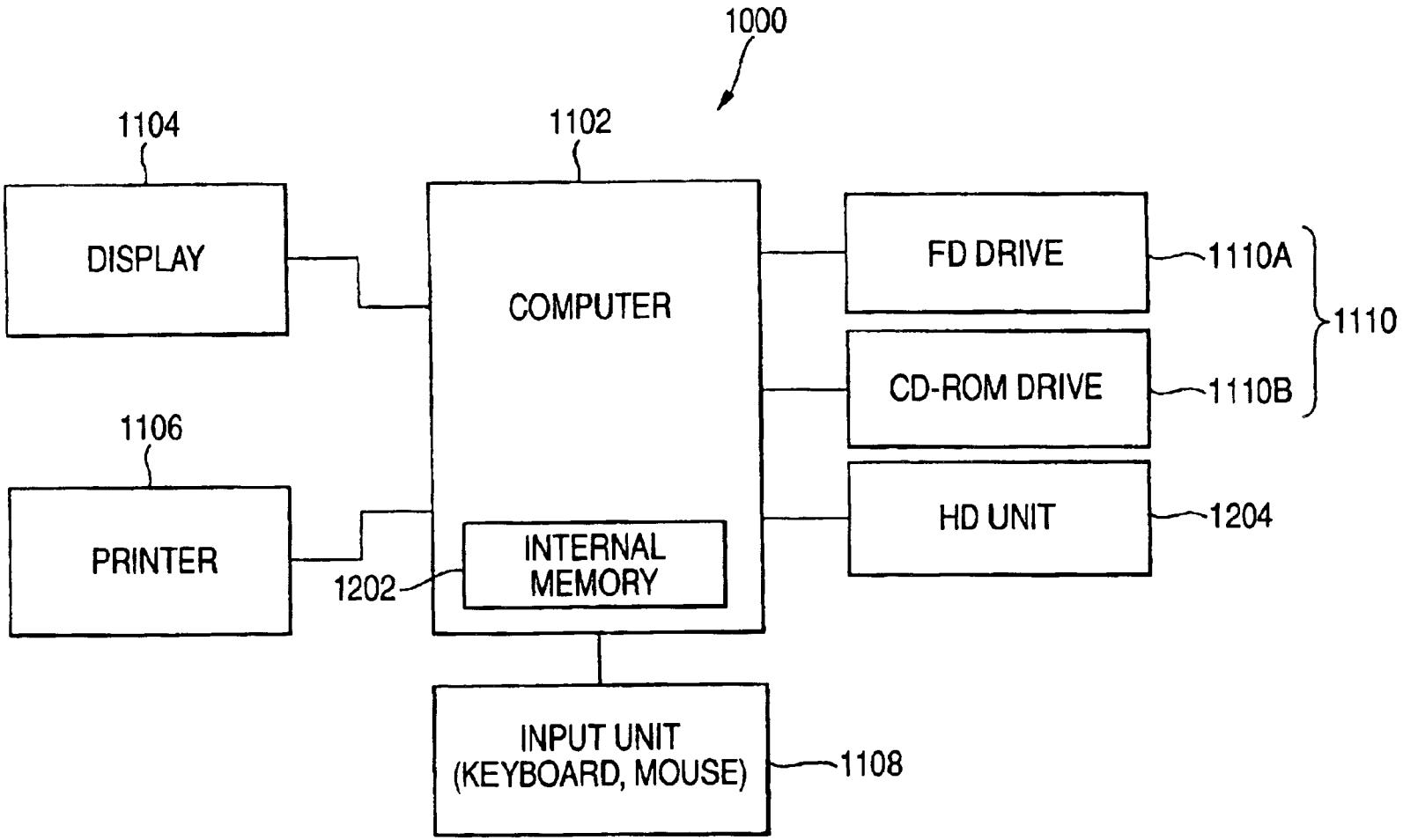
FIG. 7 is a block diagram to show the configuration of the computer system shown in FIG. 6.
Figure 8:
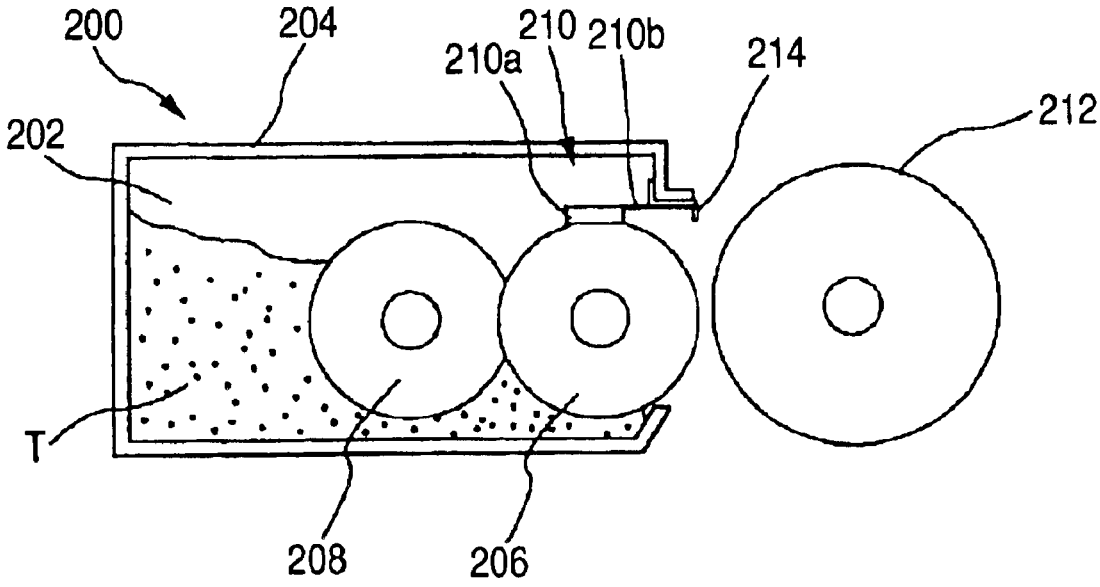
FIG. 8 is a drawing to describe a related developing device.

FIG. 7 is a block diagram to show the configuration of the computer system shown in FIG. 6. Internal memory 1202 such as RAM and external storage such as a hard disk drive unit 1204 are further installed in the cabinet in which the computer main unit 1102 is housed.

The example in which the printer 1106 is connected to the computer main unit 1102, the display 1104, the input unit 1108, and the read unit 1110 to make up the computer system has been described, but the computer system is not limited to it. For example, the computer system may be made up of the computer main unit 1102 and the printer 1106 or may not include one of the display 1104, the input unit 1108, and the read unit 1110.

For example, the printer 1106 may have some of the functions or mechanisms of the computer main unit 1102, the display 1104, the input unit 1108, and the read unit 1110. By way of example, the printer 1106 may have an image processing section for performing image processing, a display section for producing various types of display, a record medium insertion and removal section for inserting and removing a record medium recording image data picked up by a digital camera, etc., and the like.

The computer system thus implemented becomes an excellent system as the whole system as compared with a related computer system.

What is claimed is:

1. A developing device comprising:

a housing, which forms a toner storage section therein, and has a first end face and a second end face; and a roller support frame, which has a first side frame portion and a second side frame portion for supporting a rotation shaft of a developing roller at corresponding positions on inner sides of the first end face and the second end face of the housing, and the roller support frame being supported in the housing, and the roller support frame being formed of a material which has a smaller thermal expansion coefficient than a material of which the housing is formed, wherein the roller support frame is fixed integrally on the side of the second side frame portion so that a move of the roller support frame toward the second end face of the housing in a length direction of the rotation shaft of the developing roller is regulated; and wherein the roller support frame is configured on the side of the first side frame portion so that a relative move of the roller support frame toward the first end face of the housing in the length direction is allowed.

2. The developing device as set forth in claim 1, wherein the first side frame portion is formed with an unloaded hole having an inner diameter larger than a diameter of a first screw;

wherein the second side frame portion is formed with a screw hole into which a second screw is screwed;

wherein the first end face is formed with a screw hole into which the first screw is screwed at a position corresponding to the unloaded hole;

wherein the second end face is formed with an unloaded hole having an inner diameter larger than a diameter of the second screw at a position corresponding to the screw hole formed in the second side frame portion;

wherein the first screw is screwed into the hole formed in the first end face and pierces the unloaded hole formed in the first side frame portion; and wherein the second screw pierces the unloaded hole formed in the second end face and is screwed into the hole formed in the second side frame portion.

3. The developing device as set forth in claim 2, wherein the roller support frame supports both end parts of the rotation shaft of the developing roller for rotation through shaft retention members; and wherein the second side frame portion is fastened by the second screw in such a manner that the second end face of the housing is sandwiched between the second side frame portion and the shaft retention member.

4. The developing device as set forth in claim 1, wherein the first end face and the first side frame portion are formed with at least two screw holes and unloaded holes at corresponding positions; and wherein the second end face and the second side frame portion are formed with at least two unloaded holes and screw holes at corresponding positions.

5. The developing device as set forth in claim 1, wherein a gap is formed between the first end face of the housing and the first side frame portion of the roller support frame so that a slight gap is formed therebetween in a state that the housing is most contracted.

6. The developing device as set forth in claim 1, wherein the roller support frame is provided with a regulation blade for evening toner deposited on a peripheral surface of the developing roller.

7. An image formation apparatus comprising:

a developing device including:

a housing, which has a first end face and a second end face, and the housing forming a toner storage section therein; and a roller support frame, which has a first side frame portion and a second side frame portion for supporting a rotation shaft of a developing roller at corresponding positions on inner sides of the first end face and the second end face of the housing, and the roller support frame being supported in the housing, and the roller support frame being formed of a material having a smaller thermal expansion coefficient than a material of which the housing is formed, wherein the roller support frame is fixed integrally on the side of the second side frame portion so that a move of the roller support frame toward the second end face of the housing in a length direction of the rotation shaft of the developing roller is regulated; and wherein the roller support frame is configured on the side of the first side frame portion so that a relative move of the roller support frame toward the first end face of the housing in a length direction of the rotation shaft of the developing roller is allowed.

8. A developing device comprising:

a housing, which forms a toner storage section therein; and a roller support frame, which supports a rotation shaft of a developing roller, and is supported in the housing, and the roller support frame including:

a first side frame portion and a second side frame portion, which supports the rotation shaft of the developing roller;

a lower frame portion, which is connected to both the first and second side frame portions at the bottoms thereof, and supports a regulation blade which abuts a peripheral surface of the developing roller for evening toner deposited on the peripheral surface; and an upper frame portion, which is connected to both the first and second side frame portions at the tops of the first and second side frame portions, and wherein both the first and second side frame portions, the lower frame portion and the upper frame portion form a closed loop structure and support the developing roller and the regulation blade as a unit.

9. The developing device as set forth in claim 8, wherein both the first and second side frame portions and the lower frame portion are molded in one piece.

10. The developing device as set forth in claim 8, wherein the upper frame portion is fixed with both the side frame portions by screws.

11. The developing device as set forth in claim 8, wherein the roller support frame is formed of a material having a smaller thermal expansion coefficient than a material of which the housing is formed;

wherein the housing has a first end face and a second end face, and the first side frame portion and the second side frame portion are placed at corresponding positions on inner sides of the first end face and the second end face of the housing;

wherein the roller support frame is fixed integrally on the side of the second side frame portion so that a move of the roller support frame toward the second end face of the housing in a length direction of the rotation shaft of the developing roller is regulated; and wherein the roller support frame is configured on the side of the first side frame portion so that a relative move of the roller support frame toward the first end face of the housing in a length direction of the rotation shaft of the developing roller is allowed.

12. The developing device as set forth in claim 11; wherein the first side frame portion is formed with an unloaded hole having an inner diameter larger than a diameter of a first screw;

wherein the second side frame portion is formed with a screw hole into which a second screw is screwed;

wherein the first end face is formed with a screw hole into which the first screw is screwed at a position corresponding to the unloaded hole;

wherein the second end face is formed with an unloaded hole having an inner diameter larger than a diameter of the second screw at a position corresponding to the screw hole formed in the second side frame portion;

wherein the first screw is screwed into the hole formed in the first end face and pierces the unloaded hole formed in the first side frame portion; and wherein the second screw pierces the unloaded hole formed in the second end face and is screwed into the hole formed in the second side frame portion.

13. The developing device as set forth in claim 12, wherein the roller support frame supports both end parts of the shaft of the developing roller for rotation through shaft retention members; and wherein the second side frame portion is fastened by the second screw in such a manner that the second end face of the housing is sandwiched between the second side frame portion and the shaft retention member.

14. A rotary developing unit comprising:

a plurality of developing device, each including:

a housing, which forms a toner storage section therein; and a roller support frame, which supports a rotation shaft of a developing roller, and being supported in the housing, and the roller support frame including:

a first side frame portion and a second side frame portion for supporting the rotation shaft of the developing roller;

a lower frame portion, which is connected to both the first and second side frame portions at the bottoms thereof, and supports a regulation blade which abuts a peripheral surface of the developing roller for evening toner deposited on the peripheral surface; and an upper frame portion, which is connected to both the first and second side frame portions at the tops of the first and second side frame portions, wherein both the first and second side frame portions, the lower frame portion and the upper frame portion form a closed loop structure and support the developing roller and the regulation blade as a unit; and wherein the plurality of developing devices are placed so as to rotate around a rotation shaft of the rotary developing unit.

15. An image formation apparatus comprising:

a rotary developing unit including:

a plurality of developing device, each having:

a housing, which forms a toner storage section therein; and a roller support frame, which supports a rotation shaft of a developing roller, and is supported in the housing, and the roller support frame including:

a first side frame portion and a second side frame portion for supporting the rotation shaft;

a lower frame portion, which is connected to both the first and second side frame portions at the bottoms thereof, and supports a regulation blade which abuts a peripheral surface of the developing roller for evening toner deposited on the peripheral surface; and an upper frame portion, which is connected to both the first and second side frame portions at the tops of the first and second side frame portions, and wherein both the first and second side frame portions, the lower frame portion and the upper frame portion form a closed loop structure and support the developing roller and the regulation blade as a unit; and wherein the plurality of developing devices are placed so as to rotate around a rotation shaft of the rotary developing unit.

* * * * *